US005088263A

United States Patent [19]

Horii et al.

[11] Patent Number: 5,088,263

[45] Date of Patent: Feb. 18, 1992

[54] CONSTRUCTION APPARATUS AND CONSTRUCTION METHOD

[75] Inventors: Shuji Horii, Shinagawa; Hiroshi Teraoku, Niiza, both of Japan

[73] Assignee: Ohbayashi Corporation, Osaka, Japan

[21] Appl. No.: 668,854

[22] Filed: Mar. 15, 1991

Related U.S. Application Data

[62] Division of Ser. No. 402,811, Sep. 5, 1989, abandoned.

[30] Foreign Application Priority Data

| | | | |
|---|---|---|---|
| Sep. 5, 1988 | [JP] | Japan | 63-222048 |
| Sep. 5, 1988 | [JP] | Japan | 63-222049 |
| Jul. 27, 1989 | [JP] | Japan | 1-192680 |

[51] Int. Cl.[5] ..... E04B 1/00

[52] U.S. Cl. ..... 52/745; 52/747; 52/DIG. 12

[58] Field of Search ..... 52/741, 745, 747, 749, 52/123.1, DIG. 12; 182/178

[56] References Cited

U.S. PATENT DOCUMENTS

| | | | |
|---|---|---|---|
| 122,937 | 1/1972 | Derrom . | |
| 2,739,850 | 3/1956 | Hollingsworth . | |
| 3,017,968 | 1/1962 | McMahon . | |
| 4,374,786 | 2/1983 | McClain | 52/745 X |
| 4,528,793 | 7/1985 | Johnson | 52/745 |
| 4,557,099 | 12/1985 | Johnson | 52/745 |
| 4,827,689 | 5/1989 | Lonardi et al. | 52/747 X |
| 4,980,999 | 1/1991 | Terenzonie | 52/745 X |

FOREIGN PATENT DOCUMENTS

| | | |
|---|---|---|
| 52-27446 | 7/1977 | Japan . |
| 62-244941 | 10/1987 | Japan . |

*Primary Examiner*—David A. Scherbel
*Assistant Examiner*—Linda J. Watson
*Attorney, Agent, or Firm*—Wenderoth, Lind & Ponack

[57] ABSTRACT

A construction apparatus comprising a framework installed above a completed structure of a building so as to form a working space for construction operations including installing permanent columns over the completed structure, guide posts detachably held on the completed structure, elevating and locking mechanisms provided on the framework for elevating the framework to form the working space and for locking the framework to the guide posts, and construction equipment mounted on the framework and capable of carrying out the construction operations in the working space. The framework is provided with a cover for covering the working space. A construction method of constructing a multistory building in ascending order of stories comprises the steps of elevating a framework placed on a completed structure of the building to form a working space over the completed structure, locking the framework at an elevated position to the completed structure, sequentially installing permanent columns in the working space, installing beams between the fixed permanent columns, executing construction operations in a structure formed of the permanent columns and the beams, and disengaging the framework from the completed structure. The construction apparatus can be fabricated and the construction method can be performed at a reduced cost and, in constructing multistory buildings, the construction apparatus saves labor and enables the uninterrupted execution of construction operations regardless of weather conditions. The construction apparatus is sufficiently resistant to earthquakes.

2 Claims, 16 Drawing Sheets

FIG. 1 - PRIOR ART
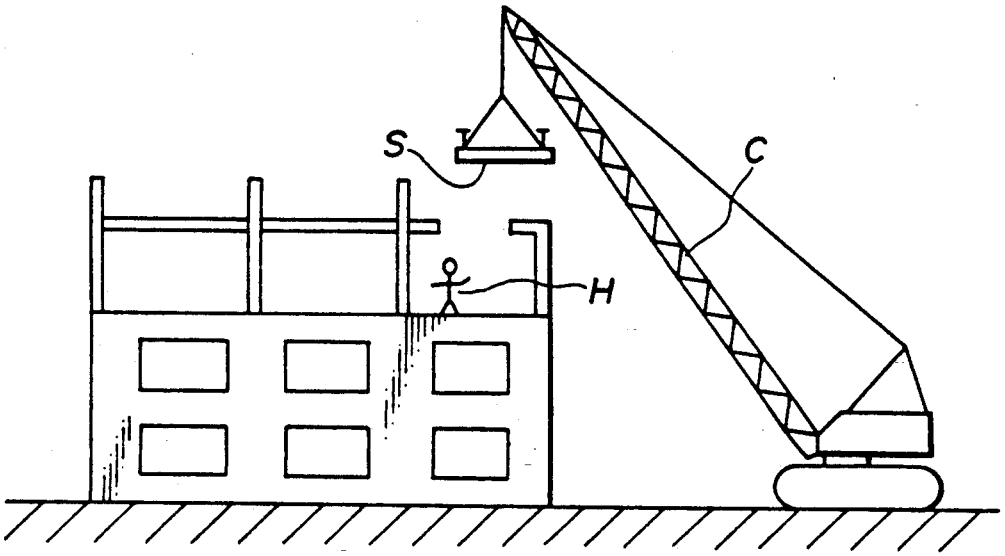
FIG.3(A)
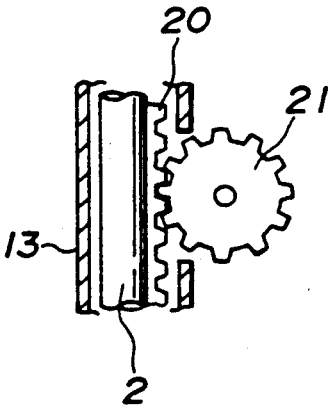
FIG.3(B)
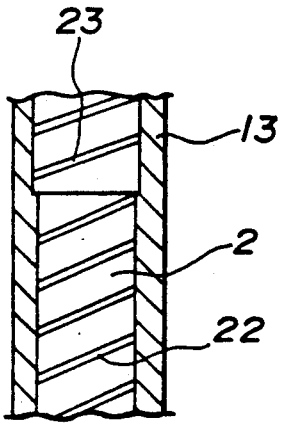

CONSTRUCTION APPARATUS AND CONSTRUCTION METHOD

This application is a continuation of patent application Ser. No. 07/402,811, filed Sept. 5, 1989 now abandoned.

BACKGROUND OF THE INVENTION

1. Field of the Invention

The present invention relates to a construction apparatus and a construction method advantageously applicable to carrying out the construction of various structures including low buildings and high buildings, using the least necessary labor and capable of enabling the construction operation to be carried out regardless of weather conditions.

2. Description of the Prior Art

In constructing a multistory building, a conventional construction method erects columns for all the stories, lifts up the component members of the multistory building preassembled on the ground including slabs by lifting machines including cranes, and then joins the component members to the columns. Another conventional construction method stacks up stories one on another by completing a lower story, and then lifting the component members of an upper story by lifting machines including cranes and assembling the component members on the lower story.

FIG. 1 is an illustration of the latter conventional construction method, in which the first and second stories of a building have been completed and the third story is under construction. A worker H standing on the floor of the third story receives building members S lifted by a crane C, and then the worker H assembles the building members S by fixing the building members S at predetermined positions by suitable means including welding and bolts.

Japanese Patent Provisional Publication (Kokai) No. 62-244941 proposes a construction method which completes one story of a building in a plant installed in the first story of the building by using machines including industrial robots, and then pushes up the complete story by a distance corresponding to the story height. This procedure is repeated to complete a multistory building.

In constructing a multistory building by the foregoing conventional construction method which erects all the columns first, and then assembles the building components lifted up by lifting machines, and the other conventional construction method which constructs the stories of a multistory building one by one from the lower stories to the upper stories substantial time and labor is necessary, the progress of the construction schedule is dependent on weather conditions, the construction period is often extended due to various restrictions (for example, not working at night), and various measures must be taken for the safety of the workers.

Although the construction method proposed in Japanese Patent Provisional Publication (Kokai) No. 62-244941 solves most of those problems involved in the foregoing conventional construction methods, this construction method has a problem that the height of the building is limited by the strength of the supporting members for pushing up a completed story of the building in view of the weight of the building and so on. Furthermore, since the weight supported by the supporting members during the construction operation increases with the progress of the construction operation and the plant is installed on the ground floor, it is possible that the stability of the support of the completed stories against an earthquake deteriorates with the progress of the construction operation.

SUMMARY OF THE INVENTION

Accordingly, it is an object of the present invention to provide a construction apparatus and a construction method advantageously applicable to the construction of various structures including high and low buildings requiring the least necessary labor and low costs.

It is another object of the present invention to provide a construction apparatus and a construction method capable of enabling construction work to be carried out regardless of weather conditions.

It is a further object of the present invention to provide a construction apparatus and a construction method capable of securing sufficient resistance to earthquakes for a structure under construction.

In one aspect of the present invention, a construction apparatus comprises a framework including beams and constructed on a completed structure so as to form a working space on the underlying completed structure, and extension columns provided on the framework and capable of being extended from the framework to support the framework above the completed structure so that the working space may be formed between the framework and the underlying completed structure. And the extension column may be contracted to install permanent columns between the lower ends thereof and the completed structure.

The extension columns provided on the framework are extended simultaneously to elevate the framework s that a temporary working space is formed between the framework and the underlying completed structure supporting the extension columns. The extended extension columns serve as temporary columns during construction work in the temporary work space over the underlying completed structure. The extension columns corresponding, respectively, to positions where permanent columns are to be installed are contracted sequentially one at a time to install the permanent columns sequentially at positions corresponding to the contracted extension columns. Thus, a working space provided with the permanent columns is formed under the framework. After a structure to be constructed in the working space has been completed, the extension columns are extended again simultaneously to form another temporary working space for constructing the next upper structure. Since the upper structures are constructed sequentially by extending and contracting the extension columns to secure a working space, the construction work can be easily controlled automatically, and the use of the construction apparatus in combination with automatic construction equipment enables automatic construction work.

A roof is formed over the framework and an enclosure is formed around the framework to shield the working space from the outside. Accordingly, the construction work can be carried out without being affected by weather conditions and without giving public nuisance to the environment. The framework and roof of the construction apparatus may be incorporated into the building as a penthouse.

The framework may be a temporary framework provided with a temporary roof and a temporary enclosure, which are the same in function as the foregoing roof and enclosure.

The enclosure columns may be hydraulic cylinders, screw jacks, or a rack-and-pinion mechanism comprising pinions rotatably supported on the framework and rods provided with racks respectively engaging the pinions.

Overhead traveling cranes detachably provided with construction robots may be provided on the framework. In some cases, the traveling cranes and the construction robots are controlled on a cylindrical coordinate system or a polar coordinate system.

Lifts each provided with a rotary floor for unloading the cargo at an optional angular position may be installed in the internal space of the building.

A control room may be constructed in the upper space of the framework.

In another aspect of the present invention, a construction apparatus comprises a framework including beams and installed on a completed structure so as to form a working space in which an upper structure including permanent columns is to be constructed on the completed structure, columns erected on and removably supported on the underlying completed structure, elevating and locking means provided on the framework, capable of being locked to the columns to hold the framework on the underlying completed structure and capable of being unlocked to enable the framework to be elevated along the columns to form a working space between the framework and the underlying completed structure, and construction means provided on the framework for construction work within the working space.

The elevating and locking means provided on the framework are fastened to the columns supported on the columns to hold the framework firmly on the underlying completed structure. Since the elevating and locking means are locked to the columns during construction work within the working space, the vibration resistance of the construction apparatus can be sufficiently secured throughout the construction work.

In forming another working space over the next upper structure, the elevating and locking means are unlocked, the framework is elevated along the columns to form another working space, and then the elevating and locking means is locked again to the columns. When the elevating and locking means are locked to the columns, the columns serve as members for forming the working space to support the framework. Then, permanent columns are erected one by one in the working space and beams are joined firmly to the permanent columns by construction means to complete a structure for the next upper story on the underlying completed structure. Such a construction work including forming a working space and constructing a structure is repeated to construct structures for the upper stories sequentially.

Thus, the construction work is advanced upward in steps by alternately repeating the elevation and locking of the framework to form working spaces sequentially. In thus carrying out the construction work by regularly advancing the working space upward in the foregoing manner and constructing a structure by using the construction means provided on the framework, the elevation of the framework and the operation of the construction means can be easily controlled automatically, and the construction apparatus, in cooperation with automatic construction equipments, enables automatic construction work.

The framework is provided with a covering for covering the working space to shield the working space from the outside, and hence the construction work can be carried out regardless of weather conditions without giving public nuisance to the environment.

Furthermore, the columns are provided with racks respectively, and the elevating and locking means are provided with pinions respectively. The combination of the columns and the elevating and locking means may be a screw-and-rod mechanism, a center hole jack mechanism or a hydraulic jack mechanism.

The construction means include column erecting robots, column welding robots, beam welding robots and external wall installing robots.

The columns may be either temporary columns or permanent columns

The framework may be provided with traveling cranes and construction robots mounted on the traveling cranes. In some cases the traveling cranes and the construction robots are controlled on a cylindrical coordinate system or a polar coordinate system.

Lifts for lifting up construction materials may be installed in the internal space of the structure, and each lift may be provided with a rotary floor to unloaded the construction materials selectively at a desired position.

A control room may be constructed in the upper space of the framework.

In a further aspect of the present invention, a construction apparatus comprises a framework placed on a completed structure of a building under construction to form a working space for construction work including installing permanent columns, elevating means provided on the framework and capable of extending downward from the framework to elevate the same and to serve as temporary columns for forming the working space over the completed structure of the building, locking mechanism provided on the lower ends of the elevating means and removably fitting the completed structure of the building, and construction means provided on the framework for construction work in the working space.

The locking mechanism is fitted with the upper ends of the permanent columns prior installed the underlying completed structure of the building.

The holding means is provided on the framework and capable of extending downward from the framework to position and hold the permanent columns installed upright in the working space at the upper ends thereof.

The permanent column has an engaging portion at the upper end thereof and the holding means have a fitting portion at the lower end thereof opposite to the upper end of the permanent column for positioning each other.

The permanent column has an engaging portion at the upper end thereof.

The permanent column has a fitting end portion at the lower end thereof fitting the engaging portion of the other permanent column prior installed the underlying completed structure of the building.

The locking mechanism have a fitting portion at the lower end thereof opposite to the upper end of the permanent column to engaging the engaging portion of the permanent column for positioning each other.

The framework can be positioned correctly relative to the completed structure of the building and the framework is restrained from lateral movement relative to the completed structure by the engagement of the fitting portion of the locking mechanism provided on the lower ends of the elevating means serving as the temporary columns and the engaging portion formed in the upper ends of the permanent columns of the underlying completed structure of the building, so that the framework can be supported securely on the completed structure of the building under construction and the earthquake resistance of the framework during the construction work is improved.

The framework is elevated by downwardly extending the elevating means serving as the temporary columns to form the working space, the permanent columns are installed in the working space by the construction means, the permanent columns is firmly positioned one at a time by extending the holding means, and the permanent columns and beams previously attached to the permanent columns or attached to the permanent columns in the working space are joined firmly to complete the structure of an upper story on the underlying previously completed structure of the building.

After completing the structure of the upper story, the framework is elevated again by the elevating means to start constructing the structure of the next upper story.

Thus, the framework is elevated repeatedly to form working spaces sequentially for the upper stories to proceed with sequentially constructing the upper stories from the lower to the upper stories. Such regular upward shift of the working space and the construction within the working space facilitate the automated control of elevating the framework, driving the holding means and the operation of the construction means, and enables automated construction work using automatic construction machines.

The fitting end portions formed on the lower ends of the permanent columns, and the engaging portions formed in the upper ends of the permanent columns bring the permanent columns for the upper structure into alignment with the permanent columns of the underlying structure in installing the permanent columns for the upper structure, so that the permanent columns for the upper structure are joined correctly and easily to those of the underlying structure.

Since the fitting portions formed on the lower ends of the holding means engage the engaging portions formed in the upper ends of the permanent columns, the permanent columns are positioned easily and held stably, the support of the framework is reinforced and hence the earthquake resistance of the framework during the construction is improved.

In a further aspect of the present invention, a construction method comprises steps of elevating a framework formed on a completed structure by simultaneously extending a set of extension columns provided on the framework to form a working space in which the next upper structure is to be formed; sequentially contracting the extension columns to sequentially form spaces for receiving permanent columns between the framework and the underlying completed structure and setting up the permanent columns in the spaces; extending beams between the permanent columns; carrying out construction work in a working space formed by the permanent columns and the beams; and repeating the foregoing sequential steps to advance the construction work upward story by story to complete a building In still a further aspect of the present invention, a construction method comprises steps of elevating a framework constructed on a completed structure to form a working space over the underlying completed structure; locking the elevated framework to the underlying completed structure; sequentially setting up permanent columns in the working space; extending beams between the fixed permanent columns; carrying out construction work in a working space formed by the permanent columns and the beams; unlocking the framework from the completed structure; and repeating the foregoing sequential steps to advance the construction work upward story by story to complete a building.

BRIEF DESCRIPTION OF THE DRAWINGS

FIG. 1 is a pictorial view for explaining a conventional construction method;

FIGS. 3(A) and 3(B) are fragmentary sectional views of essential portions of extension columns (extension means) and holding mechanisms employed in the construction apparatus embodying the present invention;

DETAILED DESCRIPTION OF THE PREFERRED EMBODIMENTS

First Embodiment

Figure 4:
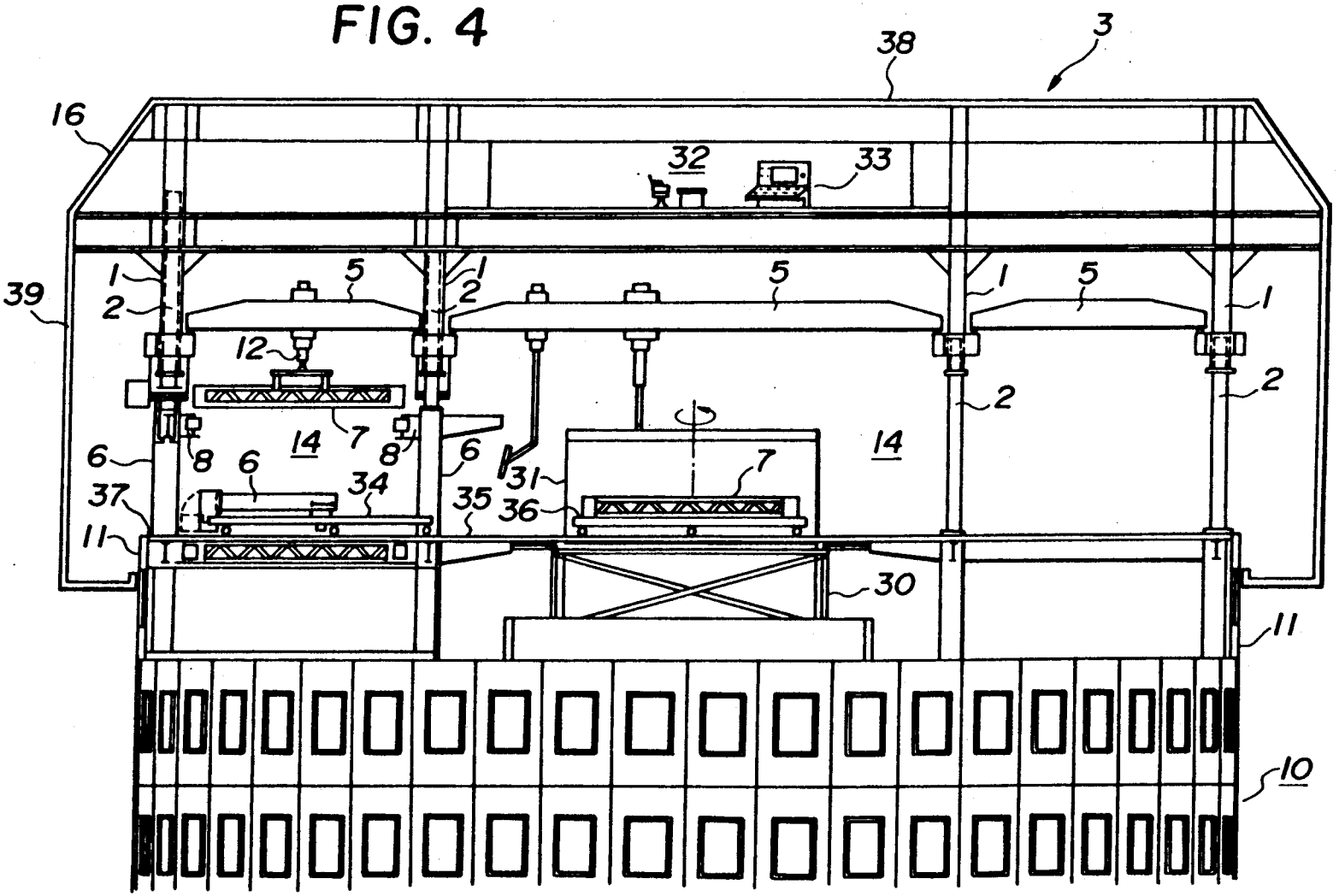
FIG. 4 is an illustration showing the construction apparatus in the first embodiment according to the present invention as applied to a practical construction operation.

The principle on which a construction apparatus in a first embodiment according to the present invention is based will be described with reference to FIGS. 2(A) to 2(F). The construction apparatus shown in FIGS. 2(A) to 2(F) by way of example comprises, as principal components, a framework 3 (either permanent or temporary) constructed on a previously completed structure of a building 10 to form a working space 14 between the framework 3 and the underlying structure, and extension columns 1 provided as part of the framework 3 and capable of extending downward from the framework 3 to serve as temporary columns for forming the working space 14 between the framework 3 and the underlying structure. The extension columns 1 may be capable of being individually contracted to form a space 15 between the lower end thereof and the underlying structure of the building 10 for receiving a permanent column 6 therein. The framework 3 is provided with a roof 16 to cover the working space 14 (FIG. 4).

In this example, four extension columns 1 are hydraulic cylinders each having a rod 2. The stroke of the rod 2 is slightly greater than the story height of a structure to be constructed on the underlying structure of the building 10.

Each of the extension columns 1 may be, as shown in FIG. 3(A), a combination of a rod 2 provided with the rack 20 along the entire length thereof, a sheath 13 fixed to the framework 3 and slidably receiving the rod 2 therein, and a pinion 21 rotatably supported on the sheath 13 and engaging the rack 20 to extend or contract the rod 2 along the sheath 13, or may be, as shown in FIG. 3(B), a combination of the rod 2 externally provided with a helical thread 22, and a sheath 13 internally provided with a helical groove 23 engaging the helical thread 22 of the rod 2, which is similar to a screw jack. The rod 2 is extended or contracted by rotating the rod 2 relative to the sheath 13.

When the framework 3 is for temporary use, the framework 3 is formed in a shape similar in the plan to the shape of the upper surface of the underlying structure of the building 10, for example, a rectangular shape as shown in FIGS. 2(A) to 2(F). When the framework 3 is for permanent use, the framework 3 is formed so as to support the roof, not shown, of a building to be constructed. The extension columns 1 are fixed to the framework 3 so as to support the same on the underlying structure of the building 10.

A traveling crane 5 is supported on opposite beams 3*a* and 3*b* of the framework 3 for travel along the beams 3*a* and 3*b*, and a welding robot 4, for example, is mounted removably on the traveling crane 5.

Figure 2A:
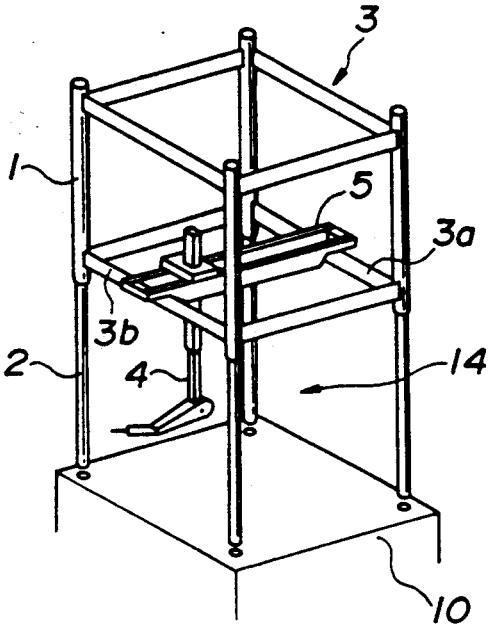
FIGS. 2(A) to 2(F) are schematic perspective views for explaining the principles of a construction apparatus in a first embodiment according to the present invention.

Referring to FIG. 2(A), the rods 2 of the four extension columns 1 are extended simultaneously to their full length to form the working space 14 between the framework 3 and the underlying structure of the building 10. In this state, the rods 2 serve as temporary columns. Then, the rod 2 of one of the extension columns 1 is fully retracted to form a space 15 for receiving a permanent column 6 between the lower end of the rod 2 and the underlying structure of the building 10. In this state, the framework 3 is supported by the other three extension columns 1. In practical application, the construction apparatus is provided with far more than four extension columns 1 to support the framework 3 by far more than four rods 2, and hence the framework 3 can be supported securely even if some of the rods 2 are fully retracted.

Figure 2B:
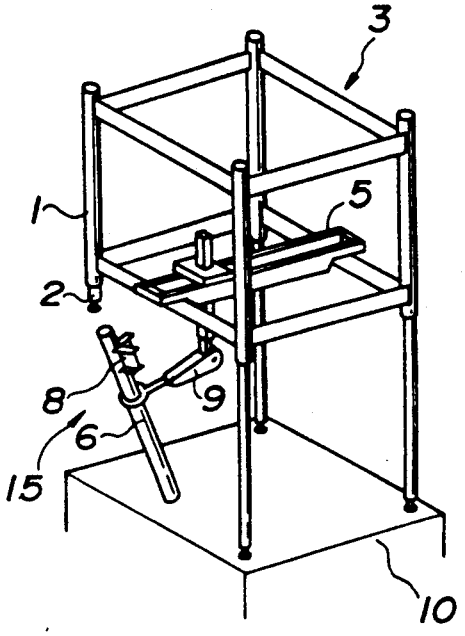

Referring to FIG. 2(B), a permanent column 6 is installed in the space 15 below the contracted extension column 1. In installing the permanent column 6, the welding robot 4 is removed from the traveling crane 5 and a column installing robot 9 capable of gripping the permanent column 6 is mounted on the traveling crane 5 to carry and install the permanent column 6.

Figure 2C:
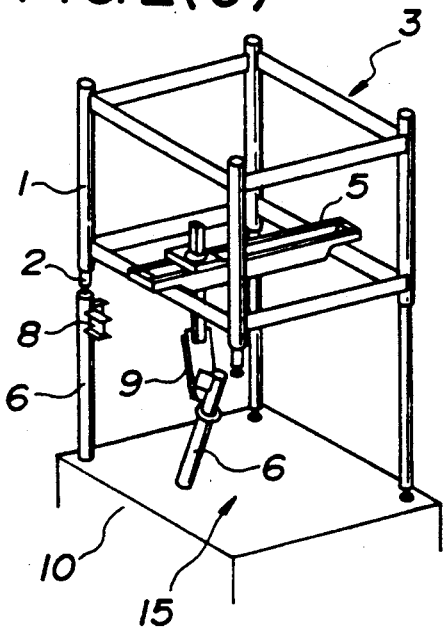

Then, as shown in FIG. 2(C), the permanent column 6 is fixed firmly to the underlying structure of the building 10, for example, by welding while the rod 2 of the extension column 1 presses the permanent column 6 against the underlying structure of the building 10. Then, the rod 2 of another extension column 1 is fully retracted and another permanent column 6 is installed fixedly on the underlying structure through the same procedure. Thus, the permanent columns 6 are installed below the four extension columns 1 on the underlying structure by repeating the same procedure, while the column installing robot 9 is moved to relevant positions by the traveling crane 5.

Figure 2D:
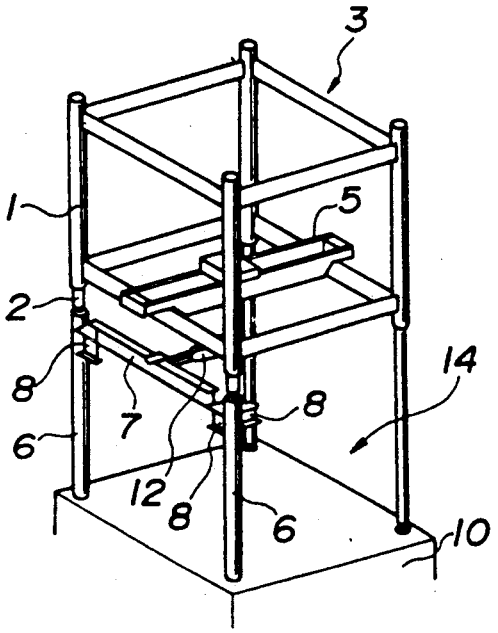

Then, as shown in FIG. 2(D), the column installing robot 9 is replaced by a beam installing robot 12, and then beams 7 are joined to the permanent columns 6 by using the beam installing robot 12.

In joining the beam 7 to the permanent columns 6, the beam 7 is extended between opposite beam joints 8 attached previously to the permanent columns 6, and then the beam 7 is fixed to the beam joints 8 by suitable means, such as welding or bolting.

The beam installing robot 12 is moved to relevant positions for joining all beams of the 7 to the respective permanent columns 6.

Figure 2E:
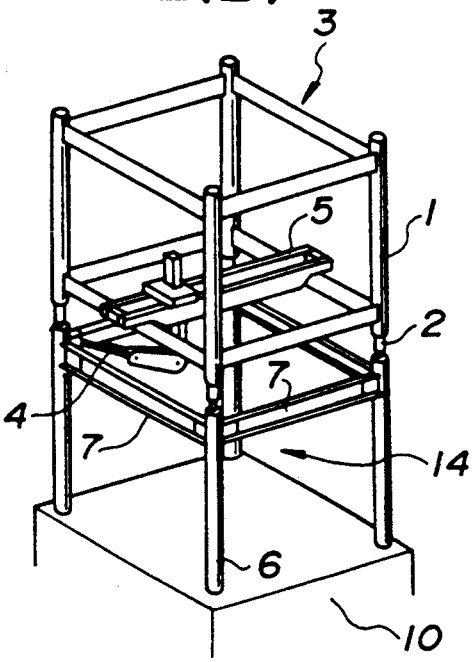

FIG. 2(E) shows a stage of the construction operation immediately after the completion of installation of the beams 7. In this example, the beams 7 are joined to the beam joints 8 by both welding and bolting; that is, first all the beams 7 are installed between and fastened with bolts and nuts to the beam joints 8 by using the beam installing robot 12, the beam installed robot 12 is replaced by the welding robot 4, and then the beams 7 are welded to the beam joints 8 by using the welding robot 4. The welding robot 4 is used also for welding floor slabs to the beams 7.

Subsequently, all the operation necessary for completing the story including installing external walls 11 (FIG. 2(F)), setting partitions, constructing booths including a service room, a bathroom and a lavatory, installing utensils and equipment, and hanging the ceiling, and flooring the slabs is carried out. The floor slabs may be joined to the beams 7 either after all the permanent columns 6 have been installed or after some of the permanent columns 6 have been installed.

Figure 2F:
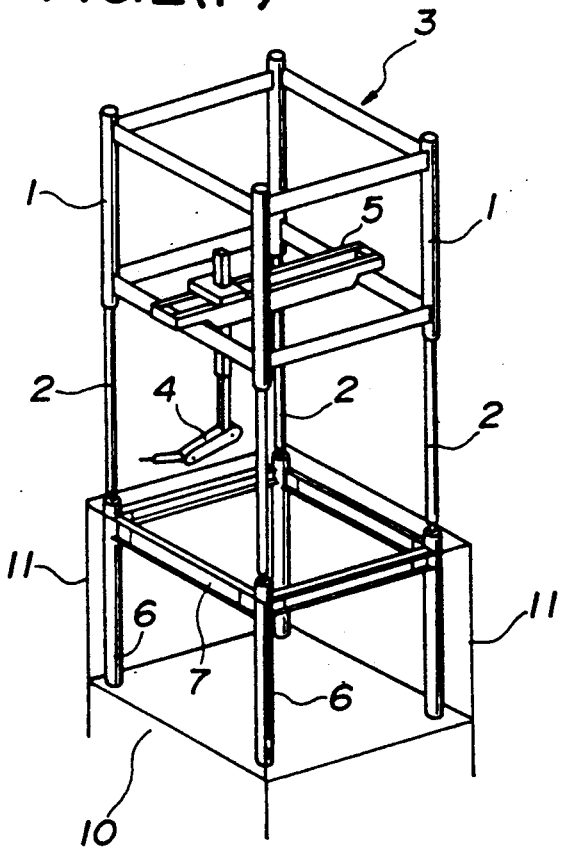

Then, as shown in FIG. 2(F), the rods 2 of all the extension columns 1 are extended simultaneously to form another working space 14 for constructing the next upper story. Then, the procedure illustrated by FIGS. 2(A) to 2(F) is repeated to construct the next upper structure.

Thus, the stories of the building are constructed sequentially from the lower stories to the upper stories to complete the building.

When the framework 3 is a temporary framework, the construction apparatus is disassembled and removed after completing the uppermost story to complete the construction operation. When the component members of the extension columns 1, the rods 2 and the framework 3 are the same strength, respectively, as the permanent columns 6 and the beams 7, the work for disassembling and removing the construction apparatus is simplified because most of the component members of the construction apparatus can be utilized for the structure of the uppermost story.

When the framework 3 is a permanent framework, the component members of the construction apparatus except the roof, the framework 3 and the extension columns 1 are removed after constructing the structure of the uppermost story, and then the uppermost story is finished to complete the construction of the building. If each of the extension columns 1 is a combination of the sheath 13 and the rod 2 as shown in FIG. 3(B), the sheath 13 and the rod 2 are designed so that the extension column 1 is equivalent in size and strength to the permanent column 6 when the rod 2 is fully retracted into the sheath 13.

FIG. 4 shows a construction apparatus of the first embodiment according to the present invention as applied to a practical construction operation, in which parts like or corresponding to those previously described with reference to FIGS. 2(A) to 2(F), 3(A) and 3(B) are denoted by the same reference characters.

Shown in FIG. 4 is the construction apparatus embodying the present invention as applied to the construction of an annular building 10 requiring the least necessary workers. An elevator shaft 30 having installed therein an elevator 31 is constructed in a central space of the building 10 so that the elevator 31 can transport construction materials including permanent columns 6 and beams 7.

When a framework 3 is a temporary framework, the framework 3 is formed in a shape substantially the same in horizontal projection as the horizontal section of the building 10. A control room 32 is constructed on the framework 3.

When the framework 3 is a permanent framework, the framework 3 and a roof 16 formed on the framework 3 are incorporated into the building 10. In this case, the control room 32 is constructed in a space under the roof 16.

Cylindrical buildings and semispherical buildings facilitate the accurate control of construction robots by using a control system under a cylindrical coordinate system or a polar coordinate system, which enables the building to be constructed at a reduced construction cost.

An operator operates a controller 33 including a computer and installed in the control room 32 to carry out automatically all the steps of the construction work previously described with reference to FIGS. 2(A) to 2(F).

A truck 34 loaded with permanent columns 6 is lifted to a story under construction by the elevator 31 from the ground, the permanent columns 6 are carried and installed sequentially at predetermined positions below extension columns 1 by a column installing robot 9 mounted on a traveling crane 5 (FIG. 2(B)), and then the permanent columns 6 are welded to the upper ends of the permanent columns 6 of the underlying story at positions near the floor slabs 35 by a welding robot 4.

A truck 36 loaded with beams 7 is lifted to the story by the elevator 31 from the ground, and the beams 7 are installed fixedly between the opposite beam joints 8 of the permanent columns 6 by a beam installing robot 12.

The floor of the elevator 31 is rotatable through an angle of 360° to direct the trucks 34 and 36 in a desired directions so that the trucks 34 and 36 are able to move to desired positions suitable for installing the permanent columns 6 and the beams 7.

After all the permanent columns 6 and all the beams 7 have been thus installed in place, construction operations necessary for the story including attaching external wall panels 11 by means of quick fasteners 37, flooring the floor slabs 35 and hanging the ceiling are carried out by construction robots mounted on the traveling cranes 5.

After the story has been completed, the rods 2 of the extension columns 1 are extended simultaneously to form a working space for construction operations for constructing the next upper story. Then, the next upper story is constructed in the same manner as described above.

When the framework 3 is a temporary framework, the construction apparatus and the control room 32 are removed after the completion of ,construction of the uppermost story, and then a roof 38 is constructed.

When the component parts of the construction apparatus are of the same strength as the permanent columns 6 and the beams 7, those component parts may be incorporated into the uppermost story of the building 10. The roof 16 constructed on the framework 3 may also be used as a permanent roof to be incorporated into the building 10 if the strength of the roof 16 is the same as that of the permanent one.

When the framework 3 is a permanent framework, the control room 32 and the components of the construction apparatus except the framework 3, the roof 16 and the extension columns 1 are disassembled and removed after completing the uppermost story. If required, the equipment of the control room 32 including the controller 33 are removed and the control room 32 may be left as it is as the uppermost story of the building 10.

When the framework 3 is a temporary framework, the framework 3 is covered with the temporary roof 38 and enclosed with a temporary enclosure 39 to arrest noise generated by the construction operation, to prevent the influence of environmental radiowaves and electromagnetic waves on electrical communication between the controller 33 installed in the control room 32 and the construction equipment including the construction robots and to shield the control room 32 and the working space 14 from rain and wind.

When the framework 3 is a permanent framework, the framework 3 is covered and enclosed with the roof 16 having an enclosure hanging from the periphery of the roof 16 for the same purposes as those of the temporary roof 38 and the temporary enclosure 39.

Providing the roof 16 and the enclosure for the permanent framework 3, or the temporary roof 38 and the temporary enclosure 39 for the temporary framework 3 with a soundproof capability and a radiowave and electromagnetic wave intercepting capability make it possible to maintain the working environment in a satisfactory condition and prevents the uncontrolled operation of the computer of the controller 33 and the construction robots.

If the maximum length of the extension columns 1, namely, the length of the extension columns 1 when the rods 2 are fully extended, may be such as corresponding to twice the story height of the building 10 or greater, permanent columns having a length corresponding to twice the story height of the building 10 or greater can be installed.

The foregoing construction apparatus embodying the present invention has the following advantages.

The sequential progress of the construction from the lower to upper stories of a building by extending and contracting the extension columns to secure a working space for each story facilitates the automated control of the construction operation and the use of automatic construction equipment for automated construction operation.

The possibility of using the components of the construction apparatus including the permanent framework in combination with the permanent roof and the permanent extension columns which are used for the construction operation enhances the economic effect of the construction apparatus and equipment investment efficiency.

Shielding the working space by the roof and the enclosure enables the regular progress of the construction operation regardless of weather conditions.

The automation of the construction operation and the elimination of the influence of weather conditions on the construction operation make possible uninterrupted day-and-night construction thereby shortening the construction period remarkably.

Whereas the plant employed in carrying out the previously proposed construction method must support the enormous weight of an entire building structure throughout the construction period and hence the previously proposed method is applicable only to light weight buildings, the construction apparatus of the present invention is applicable to heavy weigh buildings and can be fabricated at a reduced cost because the extension columns of the construction apparatus of the present invention support only the temporary or permanent roof, the temporary or permanent framework, the temporary enclosure and the control room including the control equipment.

Second Embodiment

The principle on which a construction apparatus in a second embodiment according to the present invention is based will be described with reference to FIGS. 5(A) to 5(G) prior of the description of the construction apparatus in a second embodiment.

The construction apparatus comprises, as the essential components, a framework construction 103 installed above a completed structure of a building 110 to form a working space 114 in which permanent columns 106 are installed and the construction work is carried out over the completed structure of the building 110, guide posts 140 removably supported on the completed structure of the building 110, elevating and locking mechanisms 150 provided on the framework construction 103 to lock the framework 103 to the guide posts 140 so that the framework construction 103 can be fixed to the completed structure of the building 110 and to elevate the framework construction 103 in forming the working space 114 between the framework construction 103 and the completed structure of the building 110, extension devices 101 provided on the framework construction 103 and capable of extending downward to press the permanent columns 106 against the completed structure of the building 110, and construction equipment for the construction operation in the working space 114. The construction equipment includes a column welding robot 104, a column installing robot 109, a beam welding robot 112, and a wall installing robot, not shown. The framework construction 103 may be provided with a cover 116 for covering the working space 114. Each of the guide posts 140 is provided longitudinally with a rack 141. Each of the elevating and locking mechanisms 150 comprise a pinion 151 engaging the rack 141.

In a typical example of the construction apparatus shown in FIGS. 5(A) to 5(G), four extension devices 101 are hydraulic cylinders each having a rod 102 capable of moving by a stroke slightly greater than the story height of the building 110. The hydraulic cylinders may be substituted by the devices shown in FIGS. 3(A) or 3(B).

The shape of the framework 103 is substantially the same in plan as that of the top surface of the building 110. In this example, the framework 103 is rectangular in the plan. The extension devices 101 are attached to the framework 103, respectively, at the four corners of the same.

A traveling crane 105 is mounted on the opposite frame members, 103*a* and 103*b* of the framework 103, and one of the various pieces of construction equipment, for example the column installing robot 109, is held on the traveling crane 105.

The guide posts 140 are set upright, fastened temporarily at the lower ends thereof to beams of the completed structure of the building 110, and slidably received through guide rings 131 provided on pairs of frame members 103*c* and 103*d*, respectively. The racks 141 are welded to the guide posts 140 in suitable pitches so as to extend longitudinally along the guide posts 140, respectively.

The pinions 151 are provided on the frame members 103*d* so as to engage the racks 141. Each pinion is driven by a driving source such as a motor. The rack 141, the pinion 151 and the driving source constitute the elevating and locking mechanism 150.

Each of the elevating and locking mechanisms 150 may alternatively be a screw rod mechanism, a center hole jack mechanism or a hydraulic jack mechanism.

Thus, the framework 103 of the construction apparatus is held securely relative to the completed structure of the building 110 by the engagement of the pinions 151 of the elevating and locking mechanisms 150 with the racks 141 fixed to the guide posts 140 supported on the completed structure of the building 110. The firm connection of the elevating and locking mechanisms 150 and the guide posts 140, namely, the engagement of the racks 141 and the pinions 151, secures sufficient resistance to vibration, for example earthquakes, for the construction apparatus.

Figure 5A:
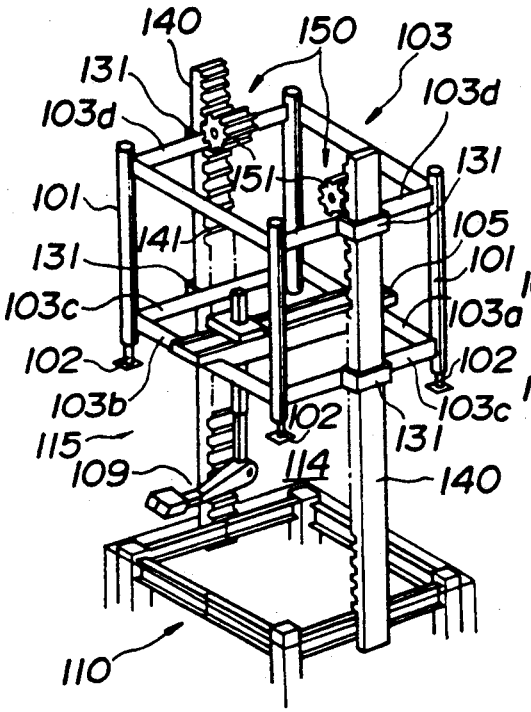
FIGS. 5(A) to 5(G) are schematic perspective views of for explaining the principle of a construction apparatus in a second embodiment according to the present invention.
Figure 5B:
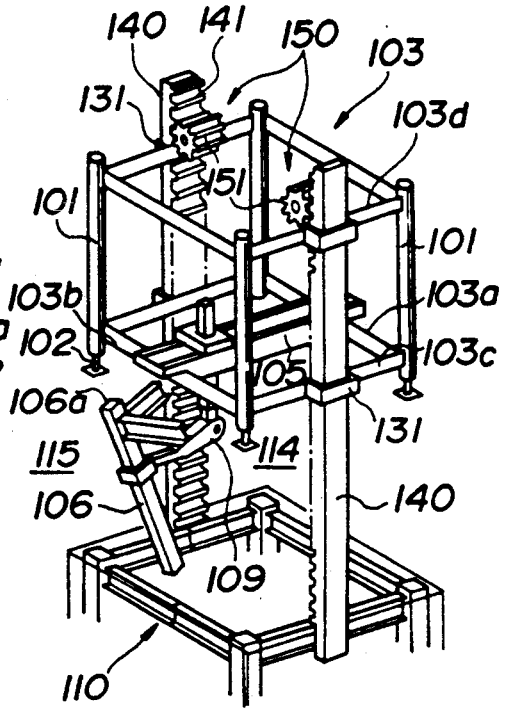

The framework 103 is elevated by driving the pinions 151 of the elevating and locking mechanisms 150 to form the working space 114 over the completed structure of the building 110, and the rods 102 of the extension columns 101 are fully retracted to form spaces 115 for receiving permanent columns 106 directly below the rods 102 as shown in FIG. 5(A). The permanent columns 106 are installed, respectively, in the spaces 115 by the column installing robot 109 as shown in FIG. 5(B).

Figure 5C:
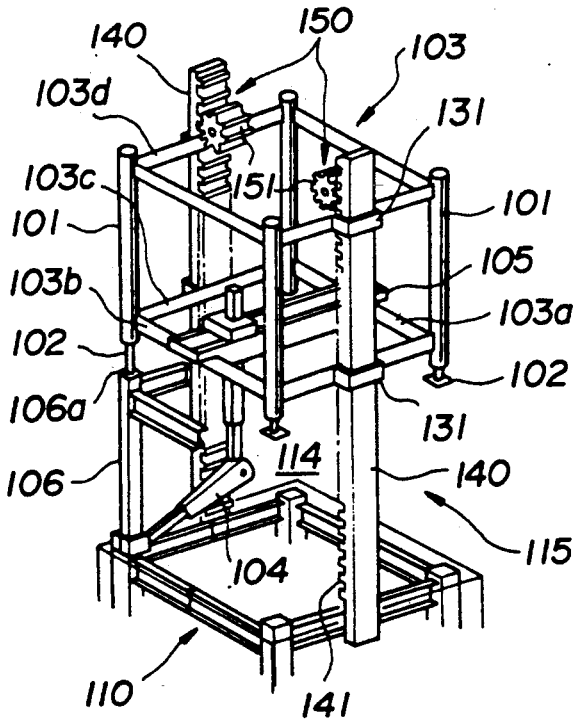

As shown in FIG. 5(C), the permanent column 106 is positioned correctly since the rod 102 of one of the extension columns 101 is extended slightly to press the permanent column 106 at the upper end 106*a* thereof against the upper end of a corresponding member of the completed structure of the building 110, and then the lower end of the permanent column 106 is welded to the upper end of the corresponding member of the completed structure of the building 110 by the welding robot 104 held on the traveling crane 105.

Although the stroke of the rods 102 of the extension columns 101 may be as small as a value sufficient to press the permanent columns 106 against the completed structure of the building 110, the stroke is set as large as the story height of the building 110 to enable the extension columns 101 to serve as temporary columns for supporting the framework 103 o the completed structure of the building 110 in this embodiment.

Figure 5D:
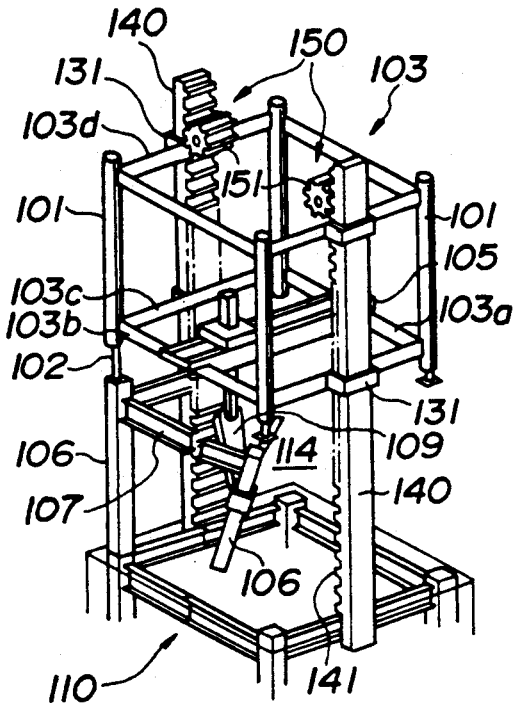
Figure 5E:
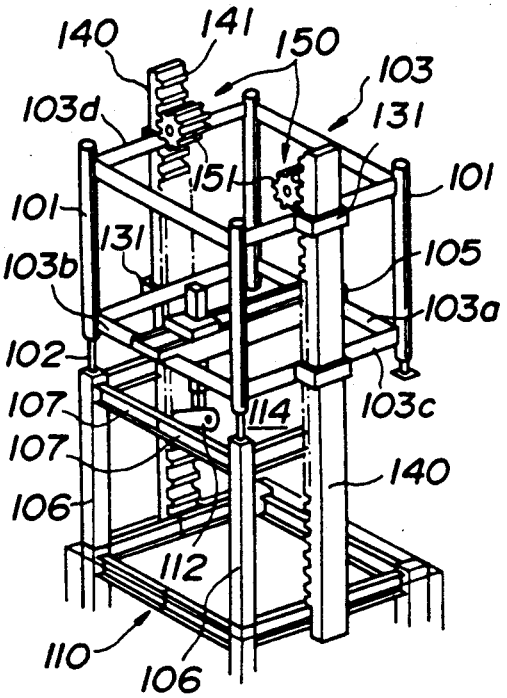

Then, as shown in FIG. 5(D), the adjacent permanent column 106 is installed and fixed in place in the same manner. Then, as shown in FIG. 5(E), beams 107 previously joined to the adjacent permanent columns 106 so as to extend toward each other are welded together by the welding robot 112 held on the traveling crane 105.

It is also possible to place a beam 107 having a length corresponding to the span between opposite beam joints attached to the opposite sides of the adjacent permanent columns 106 and to weld the beam 107 to the beam joints by the welding robot 112.

Figure 5F:
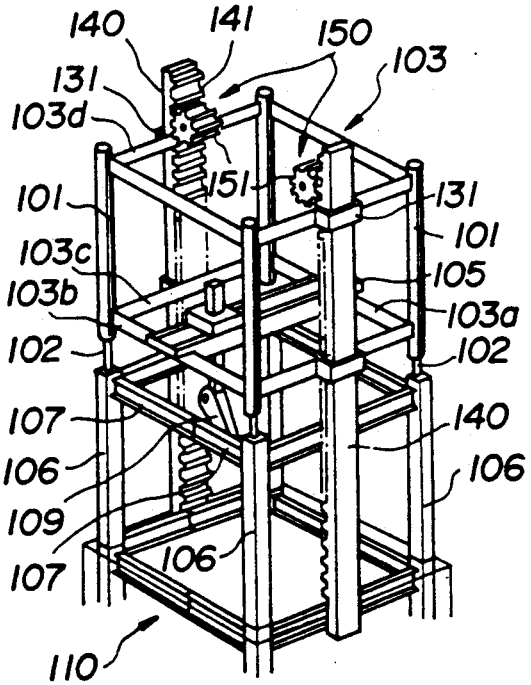
Figure 5G:
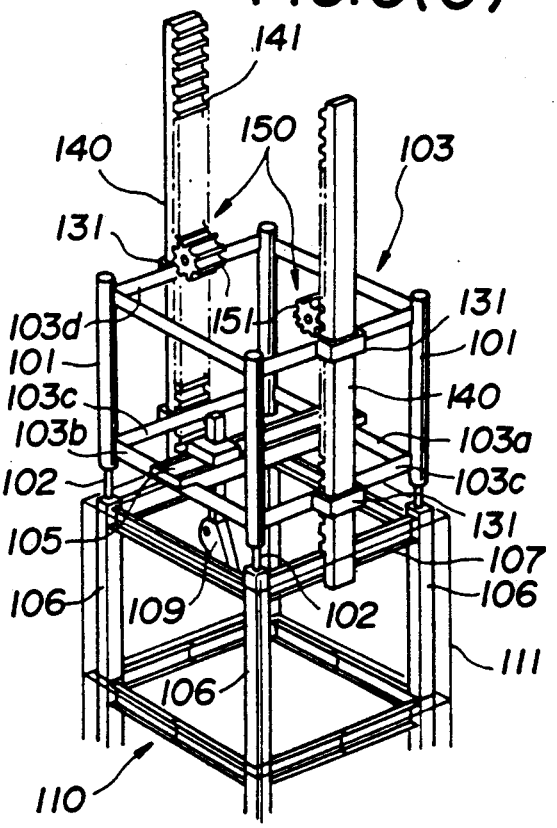

The foregoing construction procedure is repeated to complete the skeleton of an upper story on the previously completed structure of the building 110 by fixedly installing all the permanent columns 106 and joining together the beams 107 as shown in FIG. 5(F). Subsequently, the guide posts 140 are raised to positions shown in FIG. 5(G), and then a finishing operation necessary for completing the story is carried out to complete the upper story. The finishing operation includes setting external walls 111 on the skeleton (FIG. 6), installing partitions, constructing booths including a service room, a bathroom and a lavatory, installing utensils and equipment, flooring the slabs and hanging the ceiling.

After completing the story, the elevating and locking mechanisms 150 are driven to elevate the framework 103 as shown in FIG. 5(A) to form a working space 114 for constructing the next upper story. The next upper story, in a manner to the underlying story, is constructed by carrying out the steps of the construction procedure as illustrated in FIGS. 5(A) to 5(G). The construction procedure is repeated a number of times corresponding to the number of stories of the building 110 to construct upper stories on the lower stories one by one. After the uppermost story of the building 110 has thus been completed, the construction apparatus including the framework 103 and the extension columns 101 is disassembled and removed, and then the finishing operation necessary for completing the uppermost story is carried out to complete the building 110.

When the extension columns 101 and the framework 103 are formed of members having strength equivalent to or superior with respect to those forming the permanent columns 106 and the beams 107, the extension columns 101 and the framework 103 may be used as the components of the uppermost story, which simplifies the work for disassembling and removing the construction apparatus.

Figure 6:
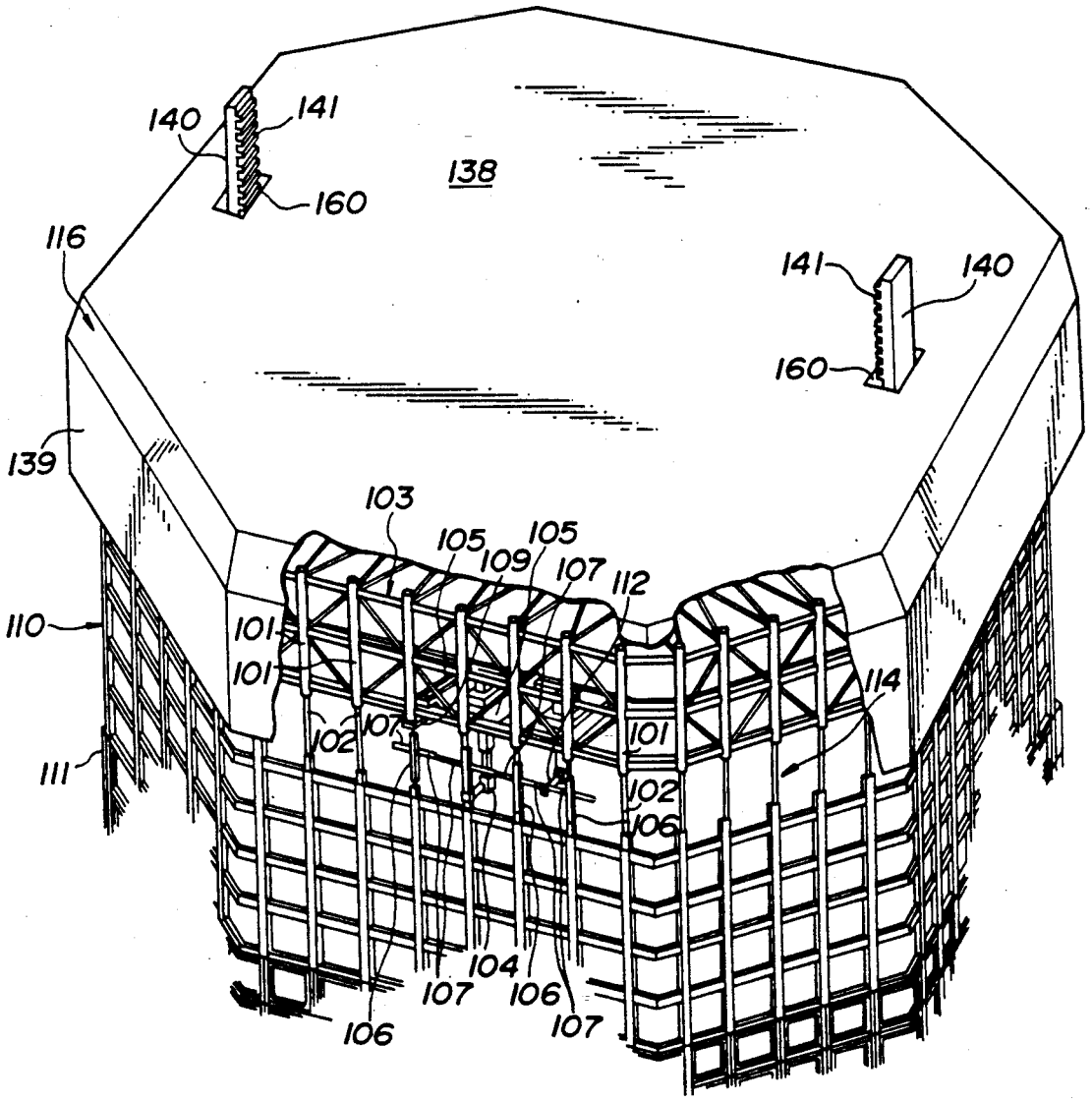
FIG. 6 is a partially cutaway schematic perspective view of the construction apparatus of the second embodiment according to the present invention as applied to an actual construction operation.
Figure 7:
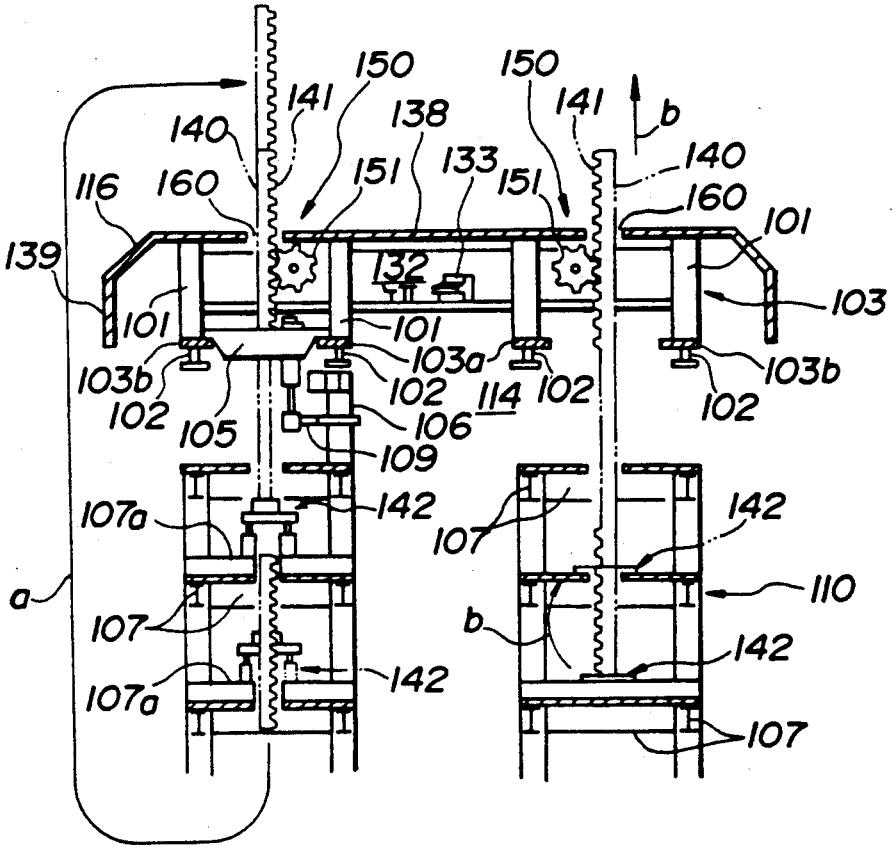
FIG. 7 is a schematic vertical sectional view taken through FIG. 6.

FIG. 6 is a perspective view showing the construction apparatus in the second embodiment as applied to practical construction, in which parts like or corresponding to those previously described with reference to FIGS. 3(A), 3(B) and 5(A) to 5(G) are denoted by the same reference characters, and FIG. 7 is a schematic sectional view for explaining the function of the construction apparatus shown in FIG. 6.

Shown in FIG. 6 is a building 110 having the shape of a polygonal cylinder. Elevators are installed in elevator shafts formed in the internal space of the building 110 to transport construction materials including permanent columns 106 and beams 107.

A framework 103 is constructed in a shape substantially the same in the plan as the building 110 and covered with a cover 116. A control room 132 is formed in a space covered with the cover 116.

An operator operates a controller 133 including a computer and installed in the control room 132 for the automatically controlling of the construction work illustrated in FIGS. 5(A) to 5(G).

The permanent columns 106 provided with the beams 107 are transported from the ground to a story under construction by the elevator, not shown, installed sequentially at positions directly below the fully retracted rods 102 of the extension columns 101 by a column installing robot 109 and welded sequentially to the upper end of the permanent columns 106 of the underlying story by a column welding robot 104. The beams 107 of the adjacent permanent columns 106 are welded together by a beam welding robot 112.

After all the permanent columns 106 have been thus installed in place and all the corresponding beams 107 have been welded together, construction operations necessary for completing the story including setting external walls 111 is carried out by using construction robots held on the traveling crane 105. After the story has been completed, elevating and locking mechanisms 150 are driven to elevate the framework 103 to form a working space for constructing the next upper story. Then the same construction operation is repeated to construct the next upper story. After all the stories of the building 110 have been completed, the construction apparatus and the control room 132 are removed, and then a roof is constructed on the uppermost story of the building 110.

The framework 103 applied to the practical construction is provided with the cover 116 consisting of a temporary roof 138 and a temporary enclosure 139 to arrest noise generated by the construction work, to prevent the influence of environmental radiowaves and electromagnetic waves on electrical communication between the controller 133 installed in the control room 132 and the construction equipment including the construction robots and to shield the control room 132 and the construction space from rain and wind.

Providing the cover 116 with a soundproof capability and a radiowave and electromagnetic wave intercepting capability enables the working environment to be maintained in a satisfactory condition and prevents the uncontrolled operation of the controller 133 and the construction robots.

As mentioned above, the extension columns 101, the rods 102 and the framework 103 can be used as components of the building 110 if the extension columns 101, the rods 102 and the framework 103 are formed of members having strengths equivalent to or superior to the permanent columns 106 and the beams 107. The temporary roof 138 may be formed in the same construction as that of the roof of the building 110 so as to use it as the permanent roof of the building 110.

The guide posts 140 may be removed after completing the uppermost story of the building 110 or may be used as the permanent column of the story after removing the racks 141. If the guide posts 140 are intended for use as the permanent columns at positions for the coaxial permanent columns 106, the guide posts 140 may be of a length corresponding to the height of the building 110 and installed, respectively, or may be sectional guide posts extended section by section during the progress of the construction work. In latter case, the guide posts may be extended by lifting a sectional guide post by a crane or the like, inserting the sectional guide post through an opening 160 formed in the temporary roof 138 onto the upper end of the guide post previously constructed and joining the sectional guide post to the upper end of the guide post. It is also possible to extend the guide posts by previously setting the temporary roof 138 at a height sufficient to provide a space for extending the new sectional guide post, and adding the sectional guide post to the previous existing portion of the guide post within the working space 114.

When the guide posts 140 are temporary sectional posts, each of the guide posts 140 may be extended upward by supporting the guide post 140 at a position above the lower end thereof on a base 142 placed on an auxiliary beam 107*a* for shifting the guide post 140, removing a portion of the guide post 140 below the position where the guide post 140 is supported on the base 142, and joining the removed portion of the guide post 140 to the upper end of the guide post 140 as indicated by an arrow a in FIG. 7. It is also possible to extend each of the guide post 140 upward by extending the rods 102 of the extension columns 101 so that the lower ends of the rods 102 are brought into firm contact with the upper ends of the previously installed permanent columns 106 to transfer the weight supported by the guide posts 140 to the permanent columns 106, driving the elevating and locking mechanisms 150 to shift the guide posts 140 upward relative to the framework 103, and seating the guide posts 140 on bases 142 placed on the beam 107 of the upper story as indicated by an arrow b in FIG. 7.

The guide posts 140 of the construction apparatus in the second embodiment support only the framework 103, the cover 116 and the construction equipment mounted on the framework 103, which are far less in weight than those supported by the plant constructed on the ground in accordance with the construction method proposed in Japanese Patent Provisional Publication (Kokai) No. 62-244941. Accordingly, the construction apparatus of the present invention is applicable to the construction of buildings unlimited in height and has a sufficiently high earthquake resistance.

The construction apparatus of the second embodiment has the following advantages.

The framework of the construction apparatus is held securely on a completed structure of a building during the construction work for constructing the next upper structure on the completed structure and hence the framework is sufficiently resistant to earthquakes throughout the construction period because the framework is locked securely to the guide posts firmly supported on the completed structure by the elevating and locking mechanisms during the construction work for constructing the next upper structure on the completed structure.

The sequential upward shift of the working space formed under the framework by the cooperative operation of the elevating and locking mechanisms and the guide posts facilitates the automated control of the construction work and enables the advantageous application of automatic construction equipment to the construction work.

The working space covered with the cover enables the construction work to be carried out regardless of weather conditions.

The construction apparatus saves labor, and enables the uninterrupted day-and-night execution of the construction work, so that the construction period is shortened remarkably and the efficiency of the construction equipments is improved

Third Embodiment

The principles on which a construction apparatus of a third embodiment according to the present invention is based will be described with reference to FIGS. 8(A) to 8(F).

Basically, a construction apparatus of the third embodiment of the present invention comprises a framework 203 placed on a completed structure of a building 210 under construction to form a working space 214 for construction work including installing permanent columns 206, elevating mechanisms 207 provided on the framework 203 and capable of extending downward from the framework 203 to elevate the same and to serve as temporary columns for forming the working space 214 over the completed structure of the building 210, locking mechanisms provided respectively on the lower ends of the elevating mechanisms 207 for removably assembling the completed structure of the building 210, and construction machines provided on the framework 203 to perform construction operations in the working space 214. Holding mechanisms 201 are provided on the framework 203 and are capable of extending downward from the framework 203 to position and hold permanent columns 206 installed in the working space at the upper ends thereof. Construction machines include a traveling crane 205, construction robots, such as a column installing robot 209, a beam installing robot 291, an external wall setting robot 292 and a welding robot 204.

The locking mechanisms are fitted with the upper ends of the permanent columns 206 previously installed on the underlying completed structure of the building 210. Practically, the permanent column 206 has a conical recess 206*y* at the upper end thereof and the holding mechanism 201 has a conical projection 202*x* at the lower end thereof opposite to the upper end of the permanent column 206 for positioning itself with respect to the column 206. The permanent column 206 also has a conical projection 206*x* at the lower end thereof adapted to fit into the conical recess 206*y* of the other permanent column 206 previously installed on the underlying completed structure of the building 210. The locking mechanism has a conical projection 208*x* at the lower end thereof opposite to the upper end of the permanent column 206 to engage the conical recess 206*y* of the permanent column 206 for positioning itself relative to the permanent column 206. It is also possible to modify the conical projections 202*x*, 206*x* and 208*x* and the conical recesses 206*y* so long as they remain complementary or to modify the conical recesses 206*y* to be simple holes.

In an example shown in FIGS. 8(A) to 8(F), the two holding mechanisms 201 are provided diagonally opposite to each other on the framework 203, and the two elevating mechanisms 207 are provided diagonally opposite to each other on the framework 203. However, a practical construction apparatus is provided with more than two holding mechanisms 201 and more than two elevating mechanisms 207.

The holding mechanism 201 is a hydraulic actuator having a rod 202 slidably received in a cylinder for projection and retraction. Each holding mechanism 201 may be constructed, as shown in FIG. 3(A) or FIG. 2(B) instead of as a hydraulic actuator, The elevating mechanism 207 comprises a hollow shaft, a post 208 having a length slightly longer than twice the story height of the building 210 and received slidably in the hollow shaft, and a hydraulic device, not shown, for moving the post 208.

As stated previously, the post 208 of each elevating mechanism 207 is provided on the lower end thereof with the conical projection 208*x*. Each permanent column 206 is provided in the upper end thereof with the conical recess 206*y* for receiving the conical projection 208*x*, and the conical projection 206*x* similar to the conical projection 208x on the lower end of the post 208. The conical projection 202x similar to the conical projection 206x is formed on the lower end of the rod 202 of the holding mechanism 201. The conical projections 208x of the posts 208, the conical projections 206x of the permanent columns 206 and the conical projections 202x of the rods 202 are capable of engaging the conical recesses 206y of the permanent columns 206.

The holding mechanisms 201 and the elevating mechanisms 207 are attached to the framework 203 and have a shape in plan substantially the same as the shape of the upper surface of a completed structure of the building 210 (a rectangular shape, in the example shown in FIGS. 8(A) to 8(F)) respectively at the four vertical edges thereof. In a practical construction apparatus embodying the present invention, the holding mechanisms 201 and the elevating mechanisms 207 are attached at appropriate intervals to the periphery of a framework similar to the framework 203

A traveling crane 205 is mounted on the opposite beams 203a and 203b of the framework 203, and a column installing robot 209 is held removably on the traveling crane 205.

In placing the framework 203 on the completed structure of the building 210, the conical projections 208x of the posts 208 of the elevating mechanisms 207 are fitted in the conical recesses 206y of the permanent columns 206 of the underlying completed structure of the building 210 t position the framework 203 correctly relative to the underlying completed structure of the building 210. The engagement of the conical projections 208x in the conical recesses 206y restrains the posts 208 from lateral movement to support the framework 203 stably so that the earthquake resistance of the framework 203 is improved. In the example shown in FIGS. 8(A) to (F), the two elevating mechanisms 207 are disposed diagonally opposite to each other, and hence the support of the framework 203 seems unstable. However, in a practical construction apparatus embodying the present invention, far more than two elevating mechanisms are arranged at appropriate intervals to support the framework 203 in a stable manner.

Figure 8A:
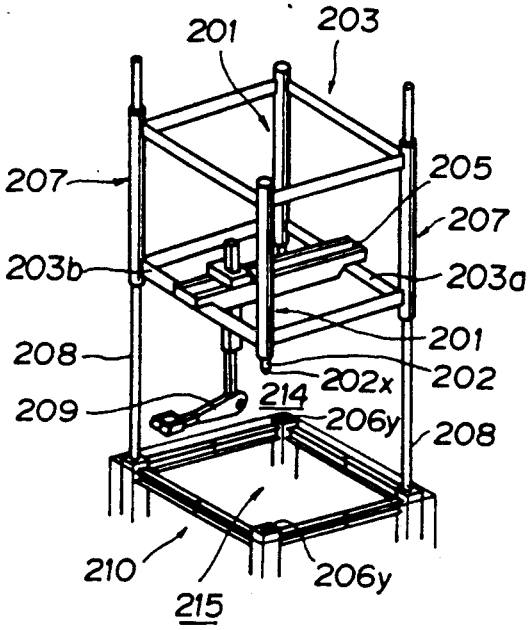
FIGS. 8(A) to 8(F) are schematic perspective views of for explaining the principles of a construction apparatus in a third embodiment according to the present invention.

The hydraulic devices of the elevating mechanisms 207 are driven to project the posts 208 downward, and thereby the framework 203 is elevated to form the working space 214 over the completed structure of the building 210 as shown in FIG. 8(A). In this state, spaces 215 for receiving the permanent columns 206 are formed directly below the retracted rods 202 of the holding mechanisms 201.

Figure 8B:
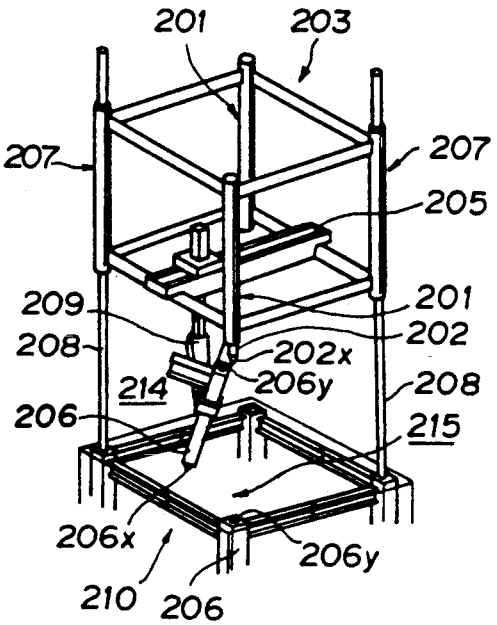

Then, as shown in FIG. 8(B), the column installing robot 209 installs a permanent column 206 in the space 215 directly below the rod 202 of the holding mechanism 201 so that the conical projection 206x formed on the lower end of the permanent column 206 is received in the conical recess 206y formed in the upper end of the permanent column 206 of the underlying completed structure of the building 210. Even if the conical projection 206x is deviated slightly from the conical recess 206y in installing the permanent column 206, the conical projection 206x and the conical recess 206y can be closely engaged by applying a small pressure to the permanent column 206. Therefore, the column installing robot 209 need not be controlled highly accurately, which facilitates the installation of the permanent column 206.

Figure 8C:
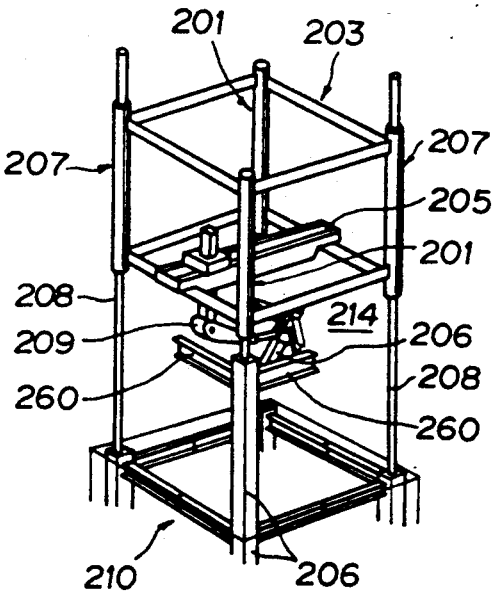

Then, as shown in FIG. 8(C), the rod 202 of the holding mechanism 201 is projected slightly so that the conical projections 202x of the rod 202 engage the conical recess 206y formed in the upper end of the permanent column 206 to position and hold the permanent column 206 in place, and then the permanent column 206 is welded to the completed structure of the building 210 by the welding robot 204 removably held on the traveling crane 205. Even if permanent column 206 is misaligned slightly relative to the rod 202, the permanent column 206 is brought into alignment with the rod 202 by the engagement of the conical projection 202x of the rod 202 and the conical recess 206y of the permanent column 206 when the permanent column 206 is pressed by the rod 202, which facilitates the correct positioning of the permanent column 206. Since the upper end and the lower end of the permanent column 206 is engaged with the rod 202 and the underlying permanent column, the permanent column 206 is held securely, the support of the framework 203 is reinforced and hence the earthquake resistance of the framework 203 during the construction is improved. Subsequently, the other permanent column 206 is installed and fixed to the underlying permanent column 206 in the same manner.

Figure 8D:
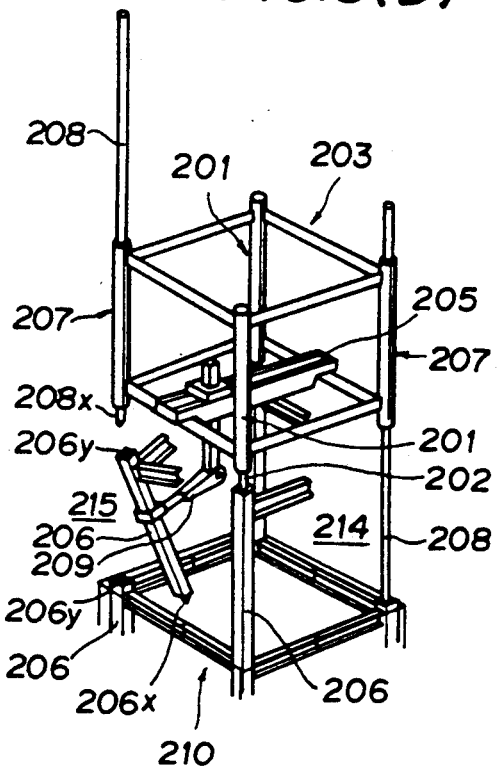
Figure 8E:
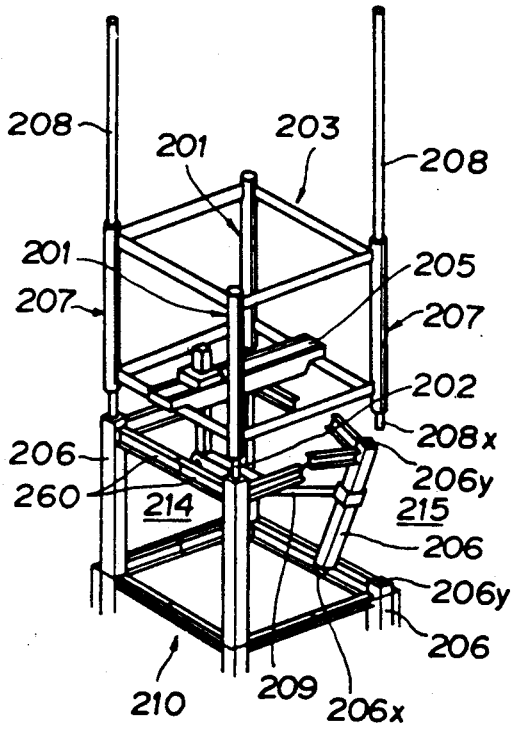

Then, as shown in FIG. 8(D), the post 208 of the elevating mechanism 207 is retracted by driving the hydraulic device of the elevating mechanism 207 to form a space 215 for installing a permanent column 206 directly below the post 208, and then the permanent column 206 is installed and fixed to the underlying permanent column 206 of the completed structure of the building 210 in the same manner as that for installing and fixing the permanent column 206 in the space 215 directly below the rod 202 of the holding mechanism 201. Then, a permanent column 206 is installed and fixed to the underlying permanent column 206 at a position diagonally opposite the previously fixed permanent column 206 as shown in FIG. 8(E).

Figure 8F:
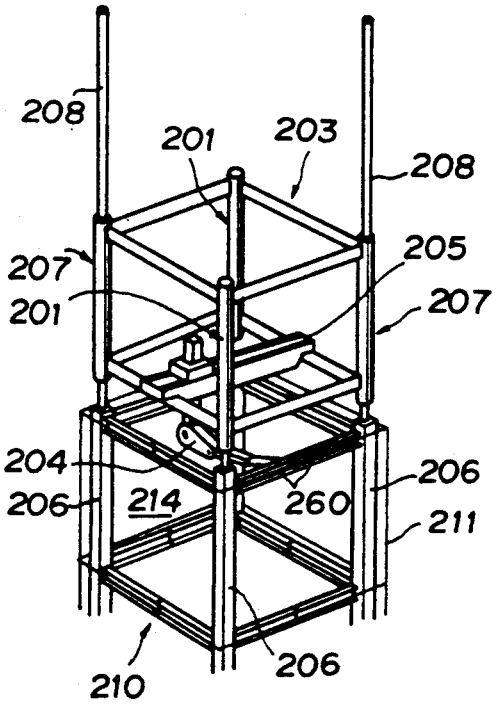

In thus setting up the permanent columns 206, beams 260 joined beforehand to the adjacent permanent columns 206 are welded together at an appropriate time by the welding robot 204 held on the traveling crane 205 as shown in FIG. 8(F). It is also possible to prepare the beams 260 and the permanent columns 206 separately and to weld each beam 260 at the opposite ends thereof to beam joints, not shown, attached to the opposite sides of the adjacent permanent columns 206.

The foregoing steps of operation of the holding mechanisms 201 and the elevating mechanisms 207 are repeated for all the permanent columns 206 and the beams 260. After all the permanent columns 206 and all the beams 260 have thus been set as shown in FIG. 8(F), all the operations necessary for completing the story including installing external walls 211 (FIG. 9), setting partitions, constructing booths, including a service room, a bathroom and a lavatory, hanging the ceiling, and flooring the slabs are performed.

Subsequently, the elevating mechanisms 207 are driven again to elevate the framework 203 as shown in FIG. 8(A) to start the construction of the next upper story, in which the steps shown in FIGS. 8(A) to 8(F) are repeated. After all the structures of the building 210 have been completed from the lower stories to the upper stories, the construction apparatus including the framework 203 and the holding mechanisms 201 i disassembled and removed, and then the uppermost story is finished to complete the building 210. When composed of members having strengths equivalent to or higher than the permanent columns 206 and the beams 260, the holding mechanisms 201, the framework 203 and the elevating mechanisms 207 can be used as the components of the structure of the uppermost story, which simplifies or enables the omission of disassembling and removing the construction apparatus.

Figure 9:
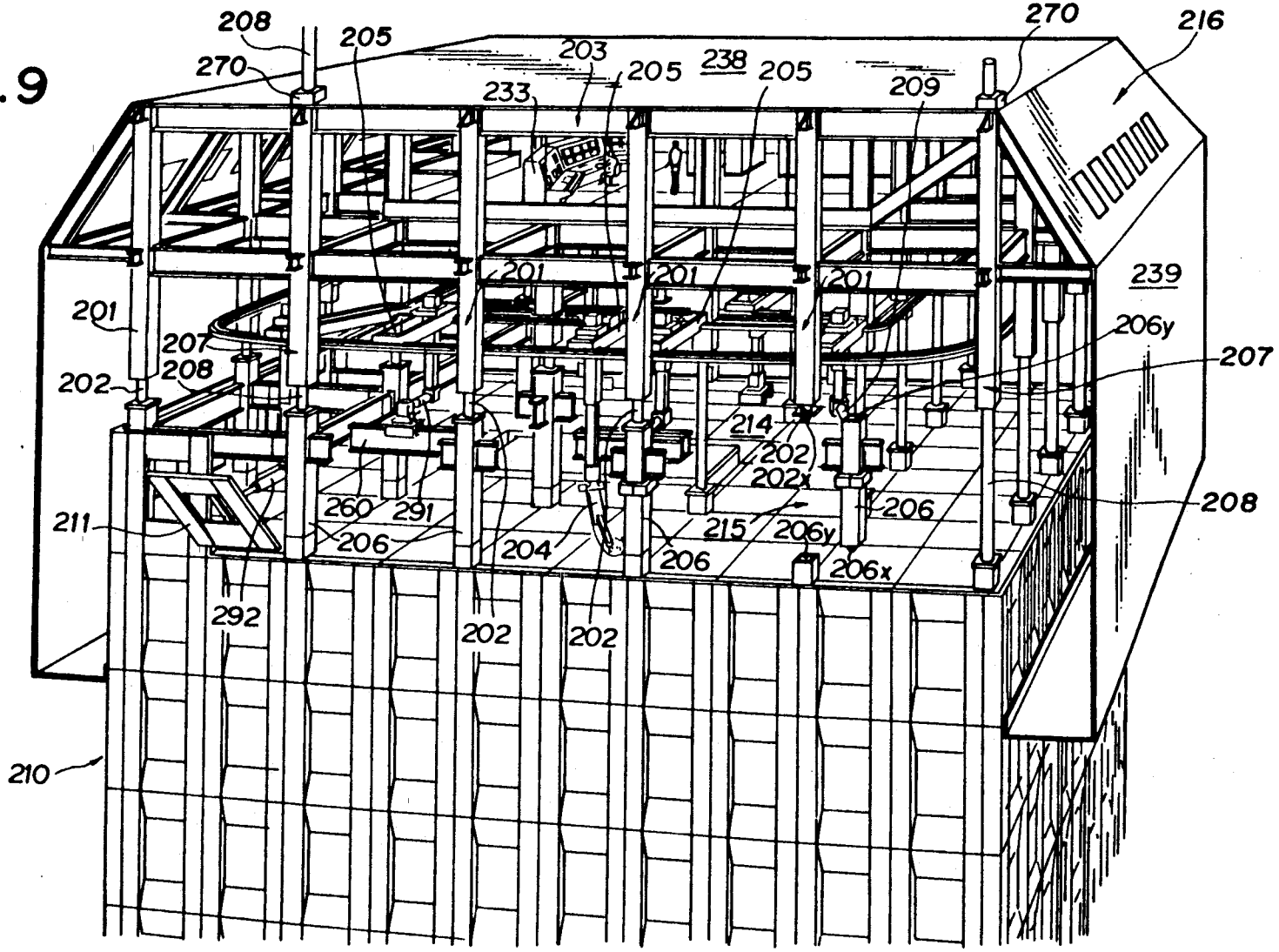
FIG. 9 is a schematic perspective view of a construction apparatus in the third embodiment according to the present invention as applied to a practical construction operation.
Figure 10:
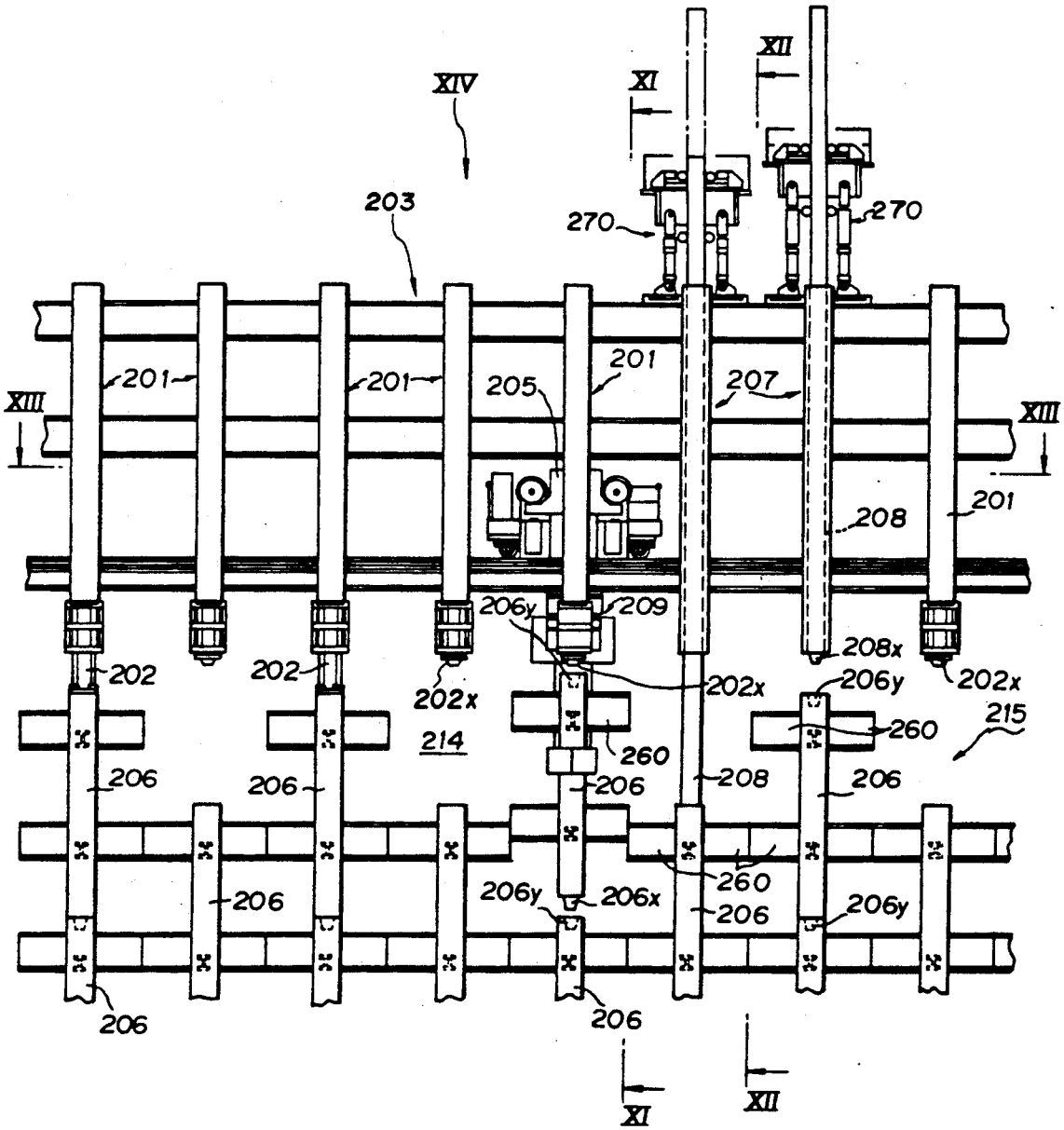
FIG. 10 is a schematic plan view of an essential portion of the construction apparatus shown in FIG. 9.
Figure 11:
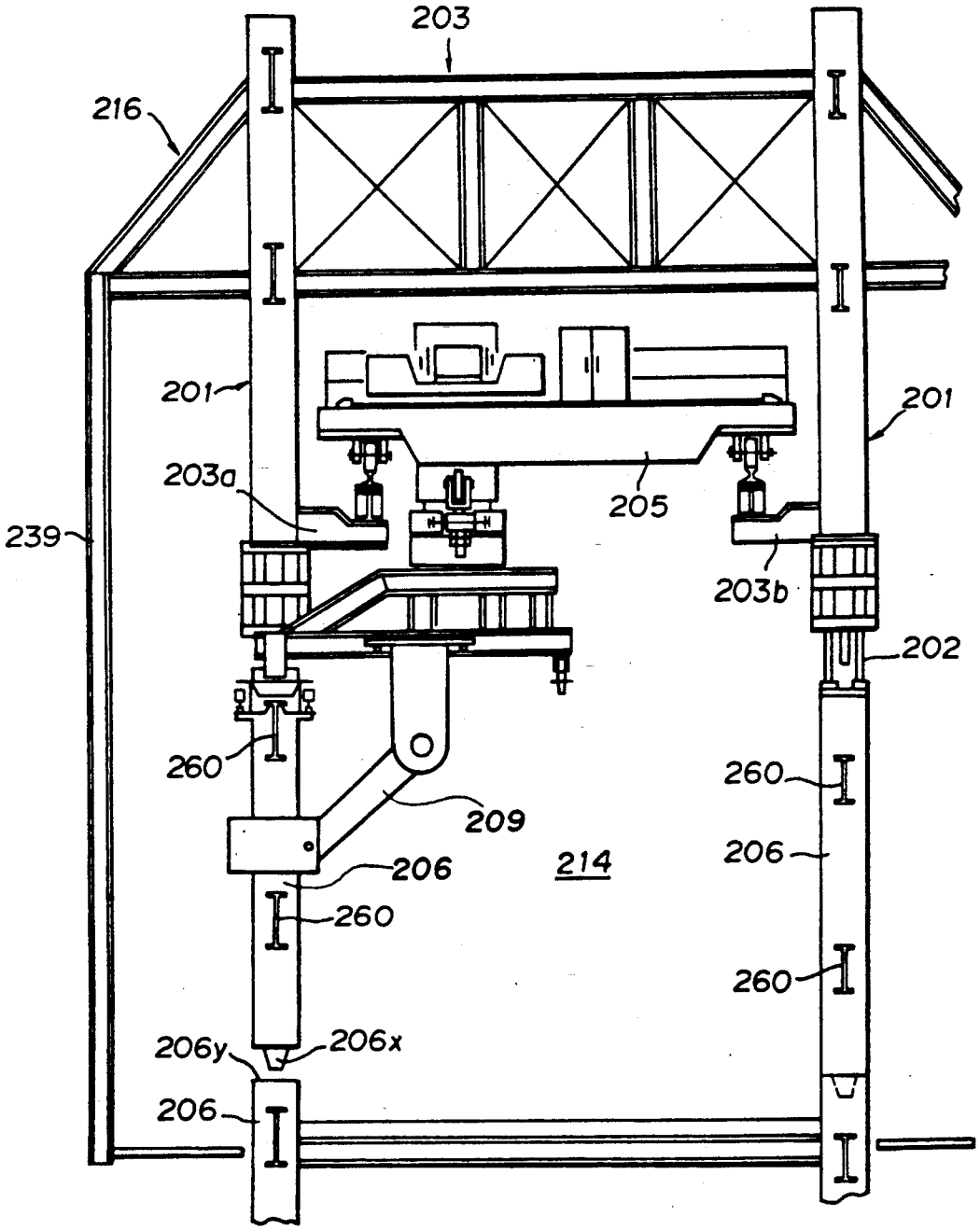
FIG. 11 is a sectional view taken on line XI—XI in FIG. 10.
Figure 12:
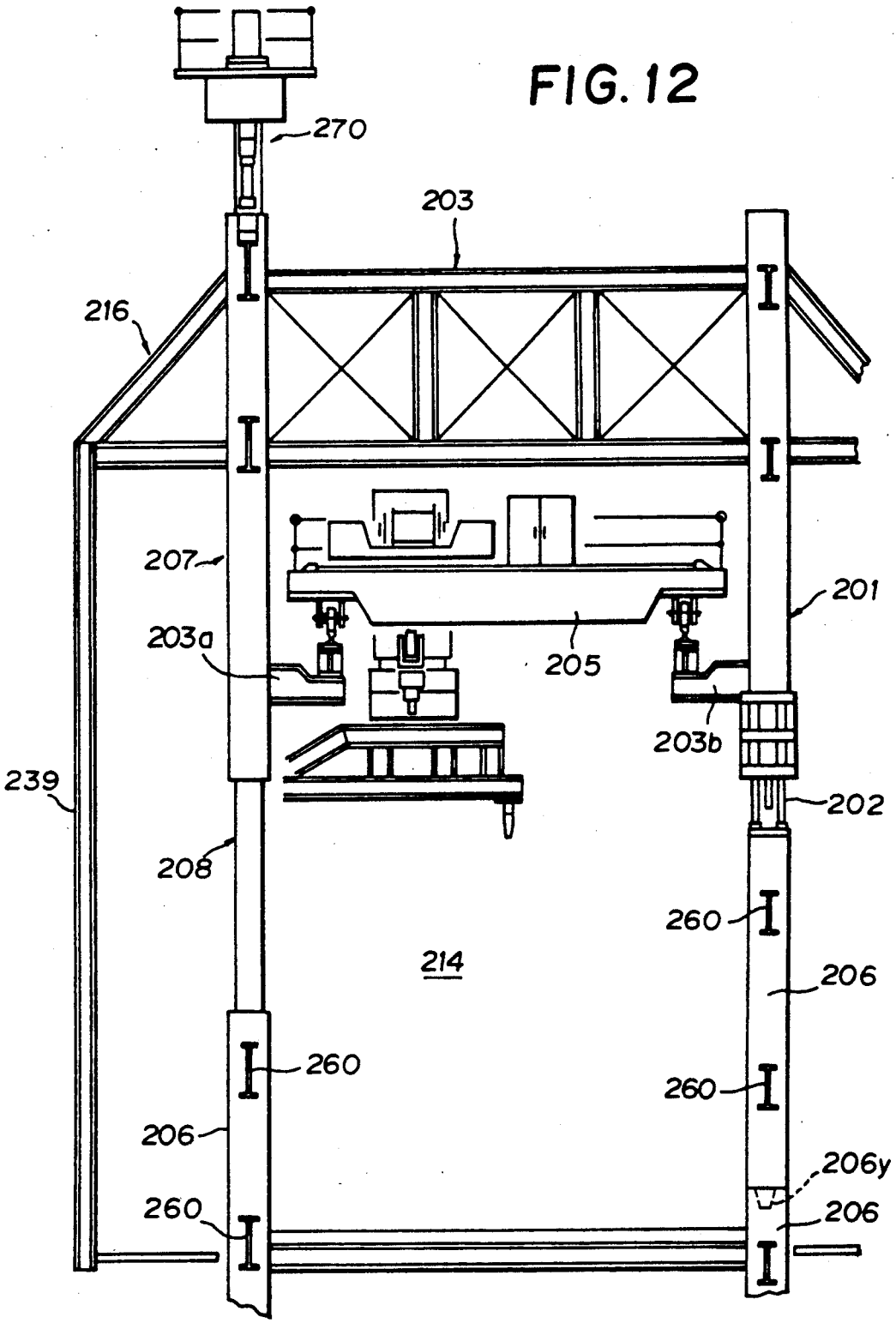
FIG. 12 is a sectional view taken on line XII—XII in FIG. 10.
Figure 13:
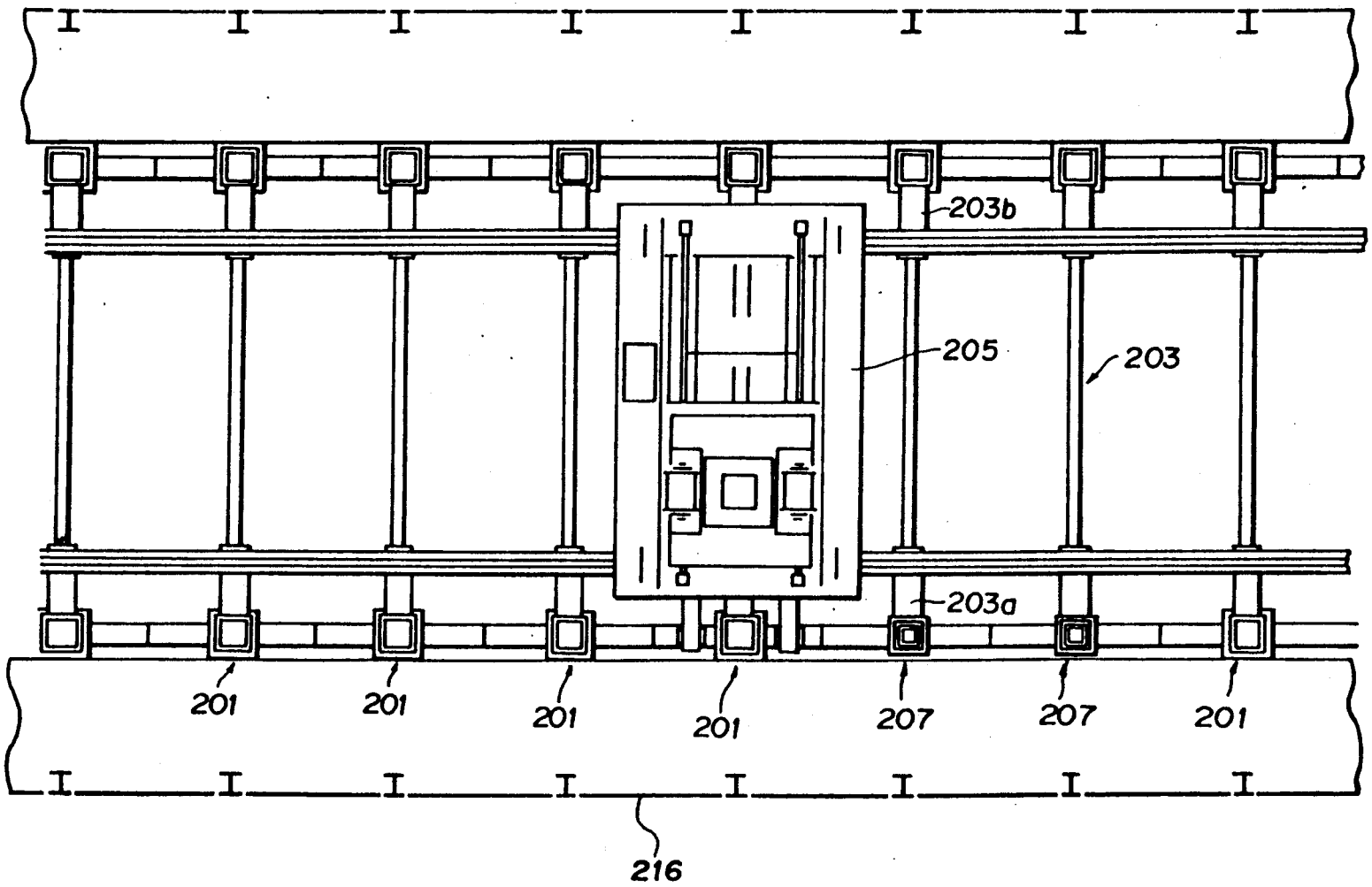
FIG. 13 is a sectional view taken on line XIII—XIII in FIG. 10.
Figure 14:
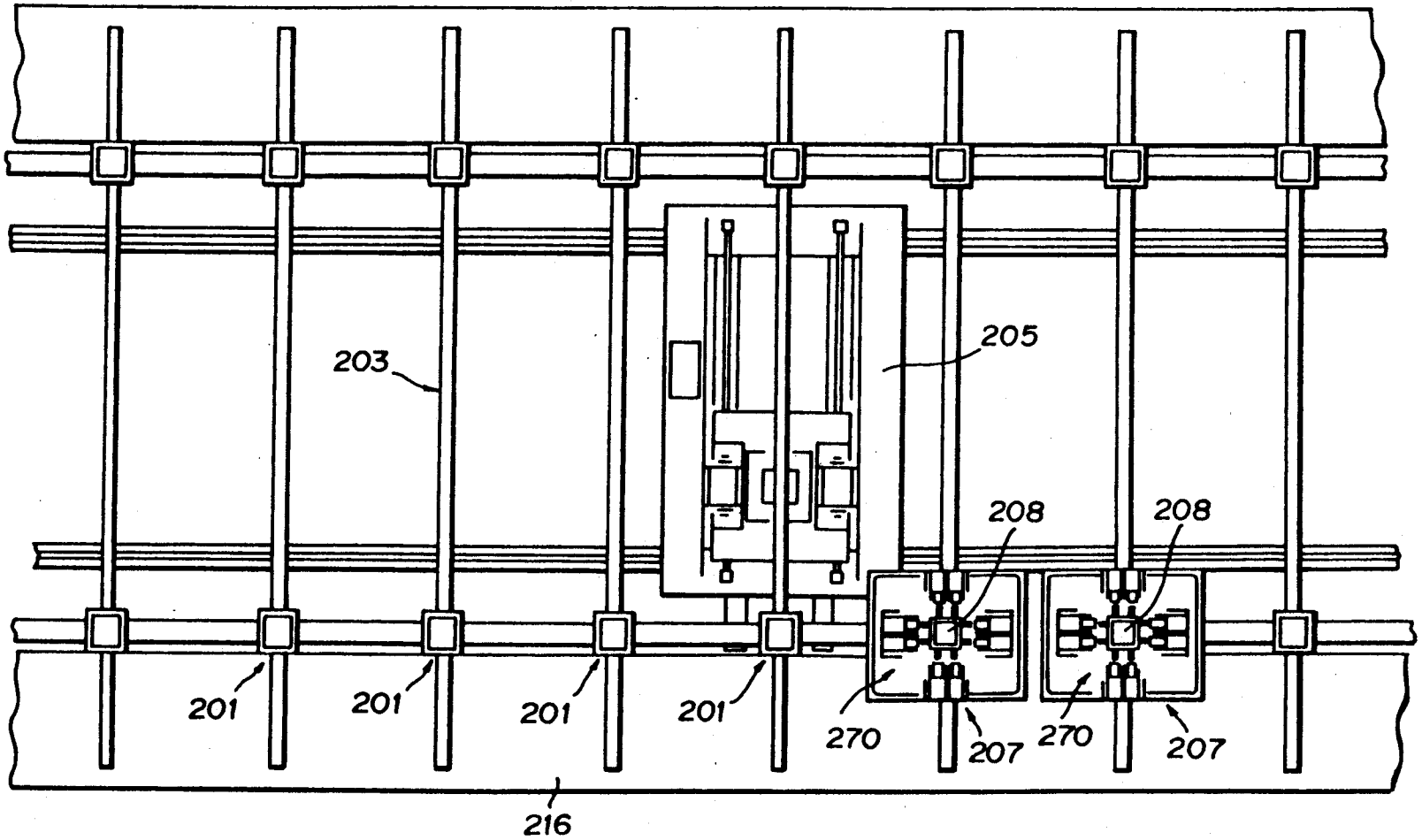
FIG. 14 is a plan view taken in the direction of an arrow XIV in FIG. 10.

FIG. 9 is a schematic perspective view illustrating a construction apparatus of the third embodiment as applied to a practical construction operation, in which parts like or corresponding to those previously described with reference to FIGS. 8(A) to 8(F), 3(A) and 3(B) are denoted by the same reference characters. FIG. 10 is a schematic plan view of an essential portion of the construction apparatus shown in FIG. 9, FIG. 11 is a sectional view taken on line XI—XI in FIG. 10, FIG. 12 is a sectional view taken on line XII—XII in FIG. 10, FIG. 13 is a sectional view taken on line XIII—XIII in FIG. 10, and FIG. 14 is a plan view as viewed in the direction of an arrow XIV in FIG. 10.

A building 210 shown in FIG. 9 is substantially rectangular in plan.

An elevator shaft is constructed in the central space of the building 210, and an elevator is installed in the elevator shaft to transport construction materials including permanent columns 206 and beams 207.

The construction apparatus is substantially the same in plan as the building 210. The framework 203 included in the construction apparatus is provided with a cover 216. A control room 232 is formed in a space covered with the cover 216.

The construction apparatus is controlled by a computerized controller 233 installed in the control room 232 and operated by an operator for automatic execution of the construction steps shown in FIGS. 8(A) to 8(F).

A plurality of elevating mechanisms 207 are arranged in pairs. Each pair of elevating mechanisms 207 are disposed adjacently. While one of the elevating mechanisms 207 of each pair is contracted the other is extended. Accordingly, the framework 203 is supported alternately by one or the other of the elevating mechanisms 207 of each pair. A hydraulic mechanism 270 for operating the elevating mechanism 207 is disposed on top of the framework 203 to project a post 208 downward from the framework 203 and to retract the post 208 upward.

Furthermore, since the post 208 of the elevating machanism 207 is held at all time by the hydraulic mechanism 270 driving the post 208, the framework 203 is firmly engaged with the post 208 even if a horizontal force such as an earthquake or a wind force acts against the framework 203. Therefore, the vibration resistance of this construction appratus is further improved.

Each of permanent columns 206 transported from the ground to a story under construction by an elevator is transported to and installed at a position specified by the computerized controller 232 by a column installing robot 209 held on a traveling crane 205, and then the permanent column 206 is welded to the upper end of a permanent column 206 of the underlying completed structure of the building 210 by a welding robot 204. Then, beams 260 previously attached to the adjacent permanent columns 206 are welded together by the welding robot 204.

Preferably, the permanent column 206 is formed higher than one story height, and attached integrally to the beams 260 extending from both sides thereof at the upper end and the lower end of the permanent column 206, respectively. Then in a practical operation, the beam 260 of the upper end of the permanent column 206 is welded to the beam 260 of the lower end of the permanent column 206 which is adjacent to the former as a result the assembly of the permanent columns 206 and the beams 260 in the one story is carried out by assembling half the number of columns 206 and beams 260, relative to the total number of columns beams supporting each story. Therefore, the efficiency of the construction work is improved compared to the case in which all the columns 206 and the beams 260 are assembled for each story.

After fixedly installing all the permanent columns 206 and all the beams 260, construction operations necessary for completing the story, including installing external wall panels 211 are carried out by the construction robots held on the traveling cranes 205. Then, the elevating mechanisms 207 are driven to elevate the framework 203 to construct a structure for the next upper story. The structure of the next upper story is constructed by repeating the same steps of the construction operation. After the structures of all the stories of the building 210 have been constructed, the construction apparatus and the control room are removed, and then the roof of the building 210 is constructed.

The cover 216 provided on the framework 203 consists of a temporary roof 238 and a temporary enclosure 239. The cover 216 arrests noise generated by the construction work, prevents the influence of disturbance, such as environmental radiowaves, on electrical signals emitted from the computerized controller 233 installed in the control room 232 to the construction machines including the construction robots, and to shield the control room 232 and the story under construction from rain and wind.

As mentioned above, when composed of members having strengths equivalent to or greater than that of the permanent columns 206 and the beams 260, the holding mechanisms 201, the framework 203 and the elevating mechanisms 207 may be incorporated into the building 210. The temporary roof 238 may be formed of the same materials and of the same construction as those of the permanent roof of the building 210 to incorporate the temporary roof 238 into the building 210 as the permanent roof.

Whereas the previously proposed plant installed on the ground floor must support the increasing enormous weight of a building throughout the construction period, the posts 208 of the elevating mechanisms 207 of the construction apparatus according to the present invention support only the framework 203, the cover 216 and the construction equipment provided on the framework 203. Accordingly, the construction apparatus has a sufficient earthquake resistance and is applicable to the construction of buildings unlimited in height.

The above construction apparatus according to the third embodiment has the following advantages.

The engagement of the conical projections of the locking mechanisms provided on the lower ends of the elevating mechanisms and the conical recesses formed in the upper ends of the permanent columns positions the framework accurately relative to the completed structure of the building, prevents the lateral movement of the framework relative to the completed structure of the building, supports the framework stably and improves the earthquake resistance of the construction apparatus during the construction.

The upward progress of the construction work by repeatedly elevating the framework by the elevating mechanisms to form working spaces sequentially for upper stories facilitates the automatic control of the construction work and the employment of automated construction equipment and saves labor.

The engagement of the conical projections formed on the lower ends of the permanent columns and the conical recesses formed in the upper ends of the permanent columns easily brings the permanent columns into alignment with the underlying permanent columns of the completed structure for correct connection of the permanent columns even if the former permanent columns are misaligned slightly relative to the latter permanent columns in installing the former permanent columns.

Since the conical projections formed on the lower ends of the holding means engage the conical recesses formed in the upper ends of the permanent columns, the permanent columns are positioned easily and held stably, the support of the framework is reinforced and hence the earthquake resistance of the framework during the construction is improved.

What is claimed is:

1. A construction method of constructing a multistory building in ascending order of stories by sequentially repeating steps of:

simultaneously extending extension columns provided on a framework placed on a completed structure of the building to form a working space over the completed structure;

sequentially contracting the extension columns one at a time to sequentially form spaces respectively for receiving permanent columns therein between the framework and the completed structure and installing permanent columns in the spaces formed sequentially;

installing beams between the adjacent permanent columns;

executing construction work in a structure formed by the permanent columns and the beams to complete the structure; and sequentially repeating the steps in that order to construct the next upper structure.

2. A construction method of constructing a multistory building in ascending order of stories by sequentially repeating steps of:

elevating a framework construction placed on a completed structure of the building to form a working space over the completed structure;

locking the framework construction to the completed structure at an elevated position;

working from said framework construction which has been elevated and locked to the completed structure, sequentially placing and fixing permanent columns on the completed structure in the working space;

installing beams between the permanent columns;

executing construction work in a structure formed by the permanent columns and the beams to complete the structure;

unlocking the framework construction from the completed structure after finishing construction work; and sequentially repeating the steps in that order to construct the next upper structure.

* * * * *